US011810710B2

(12) United States Patent
Nozawa

(10) Patent No.: US 11,810,710 B2
(45) Date of Patent: Nov. 7, 2023

(54) SINTERED R-T-B BASED MAGNET AND METHOD FOR PRODUCING THE SAME

(71) Applicant: PROTERIAL, LTD., Tokyo (JP)

(72) Inventor: Noriyuki Nozawa, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 0 days.

(21) Appl. No.: 17/680,597

(22) Filed: Feb. 25, 2022

(65) Prior Publication Data

US 2022/0310319 A1 Sep. 29, 2022

(30) Foreign Application Priority Data

Mar. 23, 2021 (JP) ..... 2021-049196
Jul. 9, 2021 (JP) ..... 2021-114084

(51) Int. Cl.

| | |
|---|---|
| ***H01F 1/057*** | (2006.01) |
| ***B22F 3/24*** | (2006.01) |
| ***H01F 41/02*** | (2006.01) |
| ***C22C 28/00*** | (2006.01) |
| ***B22F 3/26*** | (2006.01) |
| ***C22F 1/16*** | (2006.01) |
| ***C22C 1/04*** | (2023.01) |

(52) U.S. Cl.

CPC ..... *H01F 41/0293* (2013.01); *B22F 3/26* (2013.01); *C22C 1/04* (2013.01); *C22C 28/00* (2013.01); *C22F 1/16* (2013.01); *H01F 1/0577* (2013.01); *B22F 2003/248* (2013.01); *B22F 2301/45* (2013.01); *C22C 2202/02* (2013.01)

(58) Field of Classification Search

CPC ..... H01F 1/0577; B22F 2003/248
See application file for complete search history.

(56) References Cited

U.S. PATENT DOCUMENTS

2008/0286595 A1 11/2008 Koshimura et al.
2018/0025819 A1 1/2018 Shigemoto et al.
2019/0326053 A1* 10/2019 Nozawa ..... B22F 3/26

FOREIGN PATENT DOCUMENTS

WO 2007/102391 A1 9/2007
WO 2016/133071 A1 8/2016

* cited by examiner

*Primary Examiner* — Adam Krupicka
(74) *Attorney, Agent, or Firm* — KEATING & BENNETT, LLP

(57) ABSTRACT

A method for producing a sintered R-T-B based magnet includes: preparing a sintered R-T-B based magnet work (R is a rare-earth element; and T is at least one selected from the group consisting of Fe, Co, Al, Mn and Si, and contains Fe with no exception); preparing an RL-RH-B-M based alloy; and a diffusion step of performing heat treatment while at least a portion of the RL-RH-B-M based alloy is attached to at least a portion of a surface of the sintered R-T-B based magnet work. In the RL-RH-B-M based alloy, the content of RL is 50 mass % or higher and 95 mass % or lower, the content of RH is 45 mass % or lower (including 0 mass %), the content of B is 0.1 mass % or higher and 3.0 mass % is lower; and the content of M is 4 mass % or higher and 49.9 mass % or lower.

6 Claims, 2 Drawing Sheets

SINTERED R-T-B BASED MAGNET AND METHOD FOR PRODUCING THE SAME

CROSS-REFERENCE TO RELATED APPLICATION

This application claims priority to Japanese Patent Application No. 2021-049196, filed on Mar. 23, 2021, and Japanese Application No. 2021-114084, filed on Jul. 9, 2021, the entire contents of which are hereby incorporated by reference.

BACKGROUND

The present invention relates to a method for producing a sintered R-T-B based magnet, and the sintered R-T-B based magnet.

Sintered R-T-B based magnets (where R is a rare-earth element; T is mainly Fe; and B is boron) are known as permanent magnets with the highest performance, and are used in voice coil motors (VCM) of hard disk drives, various types of electric motors such as traction motors for electric vehicles (EV, HV, PHV, etc.) and electric motors for industrial equipment, home appliance products, and the like. The R-T-B based magnets decrease the size and the weight of various types of motors, and thus contribute to energy savings and reduction in the burden on the environment.

A sintered R-T-B based magnet includes a main phase which is mainly formed of an $R_2T_{14}B$ compound and a grain boundary phase that is at the grain boundaries of the main phase. The $R_2T_{14}B$ compound, which is the main phase, is a ferromagnetic material having high saturation magnetization and an anisotropy field, and provides a basis for the properties of the sintered R-T-B based magnet.

There exists a problem in that coercivity $H_{cJ}$ (hereinafter, simply referred to as "$H_{cJ}$") of sintered R-T-B based magnets decreases at high temperatures, thus causing an irreversible thermal demagnetization. For this reason, sintered R-T-B based magnets for use in traction motors for electric vehicles, in particular, are required to have high $H_{cJ}$ even at high temperatures, i.e., to have higher $H_{cJ}$ at room temperature.

It is known that substituting light rare-earth elements (mainly, Nd, Pr) in an $R_2T_{14}B$-based compound phase by a heavy rare-earth element (mainly, Dy, Tb) improves the $H_{cJ}$. However, there is a problem that such a substitution, although improving the $H_{cJ}$, decreases the saturation magnetization of the $R_2T_{14}B$-based compound phase and therefore, decreases remanence $B_r$ (hereinafter, simply referred to as "Br").

International Publication No. 2007/102391 describes, while supplying the heavy rare-earth element such as Dy or the like onto the surface of a sintered magnet of an R-T-B based alloy, allowing a heavy rare-earth element RH to diffuse into the interior of the sintered magnet. According to the method described in International Publication No. 2007/102391, Dy is diffused from the surface of the sintered R-T-B based magnet into the interior thereof, thus allowing Dy to thicken only in the outer crust of a main phase crystal grain, which is effective for the $H_{cJ}$ improvement. Thus, high $H_{cJ}$ is provided with a suppressed decrease in the $B_r$.

International Publication No. 2016/133071 describes, while the surface of a sintered R-T-B based body is in contact with an R—Ga—Cu alloy having a specific composition, performing heat treatment to control the composition and the thickness of the grain boundary phase in the sintered R-T-B based magnet and thus to improve the $H_{cJ}$.

CITATION LIST

Patent Literature

[Patent Document 1] International Publication No. 2007/102391

[Patent Document 2] International Publication No. 2016/133071

SUMMARY

It has been recently demanded, particularly for, for example, the motors for electric vehicles, to provide a sintered R-T-B based magnet having a better balance of the $B_r$ and the $H_{cJ}$ (having high $H_{cJ}$ with a suppressed decrease in the $B_r$) with the amount of use of a heavy rare-earth element, which is costly, being decreased.

Various embodiments of the present disclosure provide a method for producing sintered R-T-B based magnets having a good balance of the $B_r$ and the $H_{cJ}$ with the amount of use of a heavy rare-earth element being decreased, and such sintered R-T-B based magnets.

In an illustrative embodiment, a method for producing a sintered R-T-B based magnet according to the present disclosure includes a step of preparing a sintered R-T-B based magnet work (R is a rare-earth element and contains, with no exception, at least one selected from the group consisting of Nd, Pr and Ce; and T is at least one selected from the group consisting of Fe, Co, Al, Mn and Si, and contains Fe with no exception); a step of preparing an RL-RH-B-M based alloy (R is a light rare-earth element and contains, with no exception, at least one selected from the group consisting of Nd, Pr and Ce; RH is at least one selected from the group consisting of Tb, Dy and Ho; B is boron; and M is at least one selected from the group consisting of Cu, Ga, Fe, Co, Ni, Al, Ag, Zn, Si and Sn); and a diffusion step of heating the sintered R-T-B based magnet work and the RL-RH-B-M based alloy at a temperature not lower than 700° C. and not higher than 1100° C. in a vacuum or an inert gas atmosphere while at least a portion of the RL-RH-B-M based alloy is attached to at least a portion of a surface of the sintered R-T-B based magnet work. The RL-RH-B-M based alloy contains RL at a content not lower than 50 mass % and not higher than 95 mass %, contains RH at a content not higher than 45 mass % (including 0 mass %), contains B at a content not lower than 0.1 mass % and not higher than 3.0 mass %, and contains M at a content not lower than 4 mass % and not higher than 49.9 mass %.

In an embodiment, the sintered R-T-B based magnet work has a molar ratio [T]/[B] of T with respect to B that is higher than 4.0 and not higher than 15.0.

In an embodiment, M in the RL-RH-B-M based alloy contains at least one of Cu, Ga and Fe, and a total content of Cu, Ga and Fe in M is not lower than 80 mass %.

In an illustrative embodiment, a sintered R-T-B based magnet according to the present disclosure includes R (R is a rare-earth element and contains, with no exception, at least one selected from the group consisting of Nd, Pr and Ce); T (T is at least one selected from the group consisting of Fe, Co, Al, Mn and Si, and contains Fe with no exception); B; and at least one selected from the group consisting of Cu, Ga, Ni, Ag, Zn and Sn. A molar ratio [T]/[B] of T with respect to B in a surface region of the sintered R-T-B based magnet is lower than a molar ratio [T]/[B] of T with respect to B in a central region of the sintered R-T-B based magnet.

In an embodiment, the sintered R-T-B based magnet includes a portion in which a concentration of B gradually decreases from a surface toward an interior of the sintered R-T-B based magnet.

In an embodiment, the molar ratio [T]/[B] of T with respect to B in the surface region of the sintered R-T-B based magnet is lower, by 0.2 or more, than the molar ratio [T]/[B] of T with respect to B in the central region of the sintered R-T-B based magnet.

In an embodiment, the sintered R-T-B based magnet contains Tb at a content lower than 0.5 mass % (including 0 mass %).

An embodiment of the present disclosure provides a sintered R-T-B based magnet having a good balance of the $B_r$ and the $H_{cJ}$ with the amount of use of a heavy rare-earth element being decreased, and such a sintered R-T-B based magnet.

DETAILED DESCRIPTION

First, a fundamental structure of a sintered R-T-B based magnet according to the present disclosure will be described. The sintered R-T-B based magnet has a structure in which powder particles of a raw material alloy are bound together through sintering, and includes a main phase which is mainly formed of $R_2T_{14}B$ compound particles and a grain boundary phase which is at the grain boundaries of the main phase.

Figure 1A:
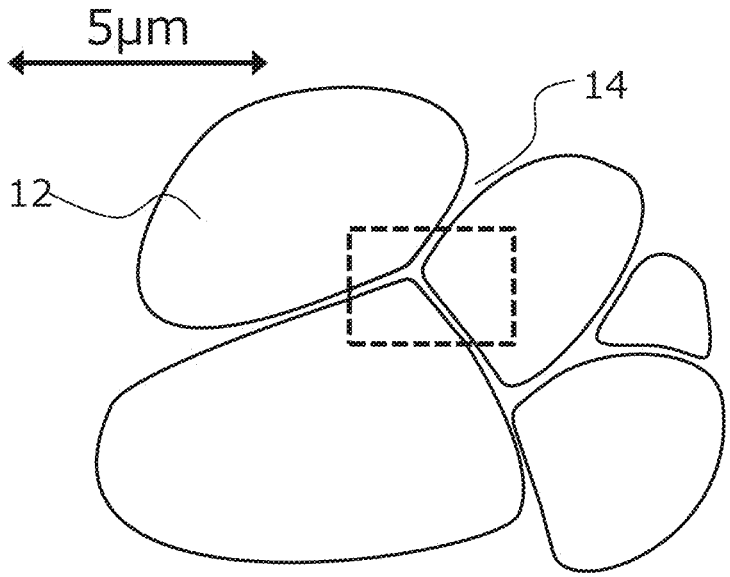
FIG. 1A is a partially enlarged cross-sectional view schematically showing a sintered R-T-B based magnet.
Figure 1B:
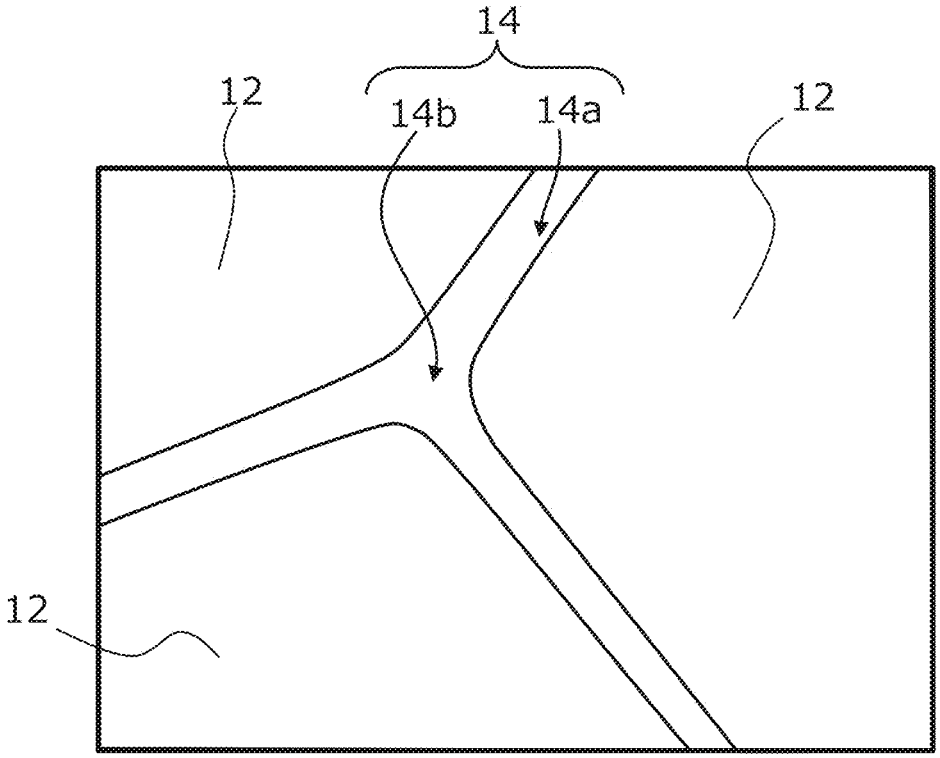
FIG. 1B is a further enlarged cross-sectional view schematically showing the interior of a broken-lined rectangular region in FIG. 1A.

FIG. 1A is a partially enlarged cross-sectional view schematically showing a sintered R-T-B based magnet. FIG. 1B is a further enlarged cross-sectional view schematically showing the interior of a broken-lined rectangular region in FIG. 1A. In FIG. 1A, a left-right arrow indicating a length of 5 μm is shown as an example of reference length to represent size. As shown in FIG. 1A and FIG. 1B, the sintered R-T-B based magnet includes a main phase 12 mainly formed of an $R_2T_{14}B$ compound and a grain boundary phase 14 at the grain boundaries of the main phase 12. As shown in FIG. 1B, the grain boundary phase 14 includes an intergranular grain boundary phase 14*a*, along which two $R_2T_{14}B$ compound grains adjoin each other, and a grain boundary triple junction 14*b*, at which three $R_2T_{14}B$ compound grains adjoin one another. A typical crystal grain size of the main phase is not less than 3 μm and not more than 10 μm, this being an average value of the diameter of an approximating circle in the cross section of the magnet. The $R_2T_{14}B$ compound, which forms the main phase 12, is a ferromagnetic material having high saturation magnetization and an anisotropy field. Therefore, in a sintered R-T-B based magnet, it is possible to improve the Br by increasing the abundance ratio of the $R_2T_{14}B$ compound, which forms the main phase 12. In order to increase the abundance ratio of the $R_2T_{14}B$ compound, an amount of R (R amount), an amount of T (T amount) and an amount of B (B amount) in the raw material alloy may be brought closer to the stoichiometric ratio of the $R_2T_{14}B$ compound (i.e., the R amount:the T amount:the B amount=2:14:1).

It is known that R in the $R_2T_{14}B$ compound, which forms the main phase 12, may partially be substituted with a heavy rare-earth element such as Dy, Tb, Ho or the like to improve the anisotropy field of the main phase while decreasing the saturation magnetization. Particularly, the outer crust of the main phase, which is in contact with the intergranular grain boundary phase, is likely to become a starting point of magnetization reversal. Therefore, a heavy rare-earth element substitution technology of replacing the outer crust of the main phase with a heavy rare-earth element with priority efficiently provides high $H_{cJ}$ with a suppressed decrease in the saturation magnetization.

It is known that high $H_{cJ}$ may also be provided by controlling the magnetism of the intergranular grain boundary phase 14*a*. Specifically, concentrations of the magnetic elements (Fe, Co, Ni, etc.) in the intergranular grain boundary may be decreased to make the intergranular grain boundary closer to being non-magnetic, so that the magnetic bond of the main phases is weakened to suppress the magnetization reversal.

As a result of studies, the present inventor has found out that the method described in International Publication No. 2016/133071 provides a sintered R-T-B based magnet having high $H_{cJ}$ with the amount of use of a heavy rare-earth element being decreased, but may decrease the $B_r$ due to the diffusion. It is considered that the $B_r$ is decreased because the R amount (especially, the amount of RL) in the vicinity of the surface of the magnet is increased due to the diffusion and as a result, the volumetric ratio of the main phase in the vicinity of the surface of the magnet is decreased. The present inventor made further studies based on such knowledge and as a result, has found out that the decrease in the volumetric ratio of the main phase in the vicinity of the surface of the magnet is suppressed by diffusing B in a narrow specific range, together with RL and M each in a specific range, from the surface into the interior of a sintered R-T-B based magnet work via the grain boundaries. In this manner, the decrease in the $B_r$ due to the diffusion is suppressed. Therefore, a sintered R-T-B based magnet having a good balance of the $B_r$ and the $H_{cJ}$ is provided with the amount of use of a heavy rare-earth element being decreased. This is considered to be realized because Fe present at the grain boundaries in the vicinity of the surface of the magnet and RL introduced by the diffusion form a main phase together with B also introduced by the diffusion. It has been found out that the sintered R-T-B based magnet provided in this manner contains R, T, B and M, and that the molar ratio [T]/[B] of T with respect to B in a surface region of the magnet is lower than the molar ratio [T]/[B] of T with respect to B in the central region of the magnet. The condition that the molar ratio [T]/[B] of T with respect to B in the surface region of the magnet is lower than the molar ratio [T]/[B] of T with respect to B in the central region of the magnet indicates that the B amount is larger in the surface region of the magnet than in the central region of the magnet. This suppresses the volumetric ratio of the main phase in the surface region of the magnet from being decreased due to the diffusion. Therefore, a sintered R-T-B based magnet has a good balance of the $B_r$ and the $H_{cJ}$ is provided.

Figure 2:
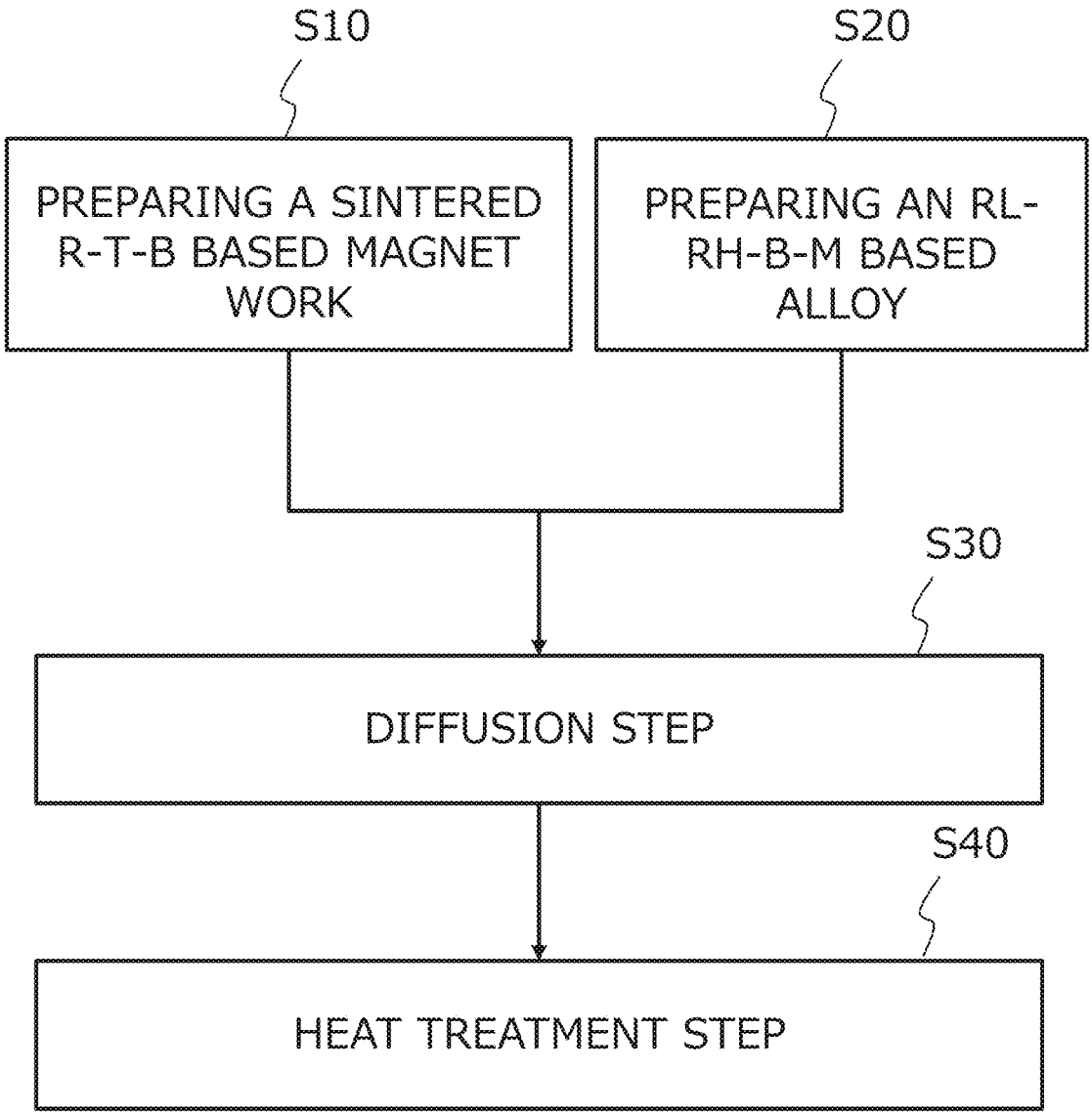
FIG. 2 is a flowchart showing example steps in a method for producing a sintered R-T-B based magnet according to the present disclosure.

As shown in FIG. 2, a method for producing a sintered R-T-B based magnet according to the present disclosure includes step S10 of preparing a sintered R-T-B based magnet work and step S20 of preparing an RL-RH-B-M based alloy. Either step S10 of preparing the sintered R-T-B based magnet work or step S20 of preparing the RL-RH-B-M based alloy may be performed first.

As shown in FIG. 2, the method for producing a sintered R-T-B based magnet according to the present disclosure further includes diffusion step S30 of heating the sintered R-T-B based magnet work and the RL-RH-B-M based alloy at a temperature not lower than 700° C. and not higher than 1100° C. in a vacuum or an inert gas atmosphere while at least a portion of the RL-RH-B-M based alloy is attached to at least a portion of a surface of the sintered R-T-B based magnet work.

In the present disclosure, the sintered R-T-B based magnet before and during the diffusion step will be referred to as the "sintered R-T-B based magnet work", and the sintered R-T-B based magnet after the diffusion step will be referred to simply as the "sintered R-T-B based magnet".

(Step of Preparing a Sintered R-T-B Based Magnet Work)

In the sintered R-T-B based magnet work, R is a rare-earth element and contains, with no exception, at least one selected from the group consisting of Nd, Pr and Ce. T is at least one selected from the group consisting of Fe, Co, Al, Mn and Si, and contains Fe with no exception. The sintered R-T-B based magnet work contains R at a content, for example, not lower than 27 mass % and not higher than 35 mass % of the entirety thereof. Fe is contained at a content not lower than 80 mass % of the entirety of T.

In the case where the content of R is lower than 27 mass %, a sufficient amount of liquid phase is not generated in a sintering step, which may make it difficult to provide a sufficiently dense texture through sintering. By contrast, in the case where the content of R is higher than 35 mass %, grain growth occurs at the time of sintering, which may decrease the $H_{cJ}$. It is preferred that the content of R is not lower than 28 mass % and not higher than 33 mass %.

The sintered R-T-B based magnet work has, for example, the following range of composition.

R: 27 to 35 mass %
B: 0.80 to 1.20 mass %
Ga: 0 to 1.0 mass %
X: 0 to 2 mass % (X is at least one of Cu, Nb and Zr)
T: not lower than 60 mass %

Preferably, in the sintered R-T-B based magnet work, the molar ratio [T]/[B] of T with respect to B is higher than 14.0 and not higher than 15.0. With such a molar ratio, higher $H_{cJ}$ is provided. In the present disclosure, "[T]/[B]" is found as follows. The analysis value (mass %) of each of the elements contained in T (T is at least one selected from the group consisting of Fe, Co, Al, Mn and Si; T contains Fe with no exception; and the content of Fe with respect to the entirety of T is not lower than 80 mass %) is divided by the molecular weight of the respective element, and a total value of such analysis values is set as [T]. The analysis value (mass %) of B is divided by the molecular weight of B, and the resultant value is set as [B]. [T]/[B] is the ratio of such values. The condition that the molar ratio [T]/[B] is higher than 14.0 indicates that the B amount used to form the main phase ($R_2T_{14}B$ compound) is smaller than the T amount used to form the main phase. It is more preferred that the molar ratio [T]/[B] is not lower than 14.3 and not higher than 15.0. With such a molar ratio, higher $H_{cJ}$ is provided. It is preferred that the sintered R-T-B based magnet work contains B at a content not lower than 0.9 mass % and not higher than 1.0 mass % of the entirety thereof.

The sintered R-T-B based magnet work may be prepared by using a generic method for producing a sintered R-T-B based magnet, e.g., a sintered Nd—Fe—B based magnet. In one example, a raw material alloy which is produced by a strip casting method or the like is pulverized by use of a jet mill or the like to have a particle size $D_{50}$ not less than 2 μm and not more than 5.0 μm, pressed in a magnetic field, and then sintered at a temperature that is not lower than 900° C. and not higher than 1100° C. In this manner, the sintered R-T-B based magnet is prepared. Pulverization to a particle size $D_{50}$ not less than 2 μm and not more than 5.0 μm provides high magnetic characteristics. This is considered to be realized because the particle size of the powder generated by the pulverization is reflected on the crystal grain size of the sintered body and this also influences the diffusion. Preferably, the particle size $D_{50}$ is not less than 2.5 μm and not more than 4.0 μm. With such a range of particle size $D_{50}$, a sintered R-T-B based magnet having a better balance of the Br and the $H_{cJ}$ is provided with the reduction in the productivity being suppressed and the amount of use of RH, which is precious, being decreased. The $D_{50}$ is a particle size at which in a particle size distribution determined by an airflow-dispersion laser diffraction method, the cumulative particle size distribution (volume-based) from the shorter-diameter side is 50%. $D_{50}$ may be measured, for example, by use of the particle size distribution measurement device "HELOS & RODOS" produced by Sympatec GmbH under the conditions of a dispersive pressure of 4 bar, a measurement range of R2, and a measurement mode of HRLD.

(Step of Preparing an RL-RH-B-M Based Alloy)

In the RL-RH-B-M based alloy, RL is a light rare-earth element and contains, with no exception, at least one selected from the group consisting of Nd, Pr and Ce. RH is at least one selected from the group consisting of Tb, Dy and Ho. B is boron. M is at least one selected from the group consisting of Cu, Ga, Fe, Co, Ni, Al, Ag, Zn, Si and Sn. The RL-RH-B-M based alloy contains RL at a content not lower than 50 mass % and not higher than 95 mass % of the entirety thereof. Examples of the light rare-earth element include La, Ce, Pr, Nd, Pm, Sm, Eu and the like. The RL-RH-B-M based alloy contains RH at a content not higher than 45 mass % (including 0 mass %) of the entirety thereof. Namely, the RL-RH-B-M based alloy does not need to contain RH. The RL-RH-B-M based alloy contains B at a content not lower than 0.1 mass % and not higher than 3.0 mass % of the entirety thereof. The RL-RH-B-M based alloy contains M at a content not lower than 4 mass % and not higher than 49.9 mass % of the entirety thereof. Typical examples of the RL-RH-B-M based alloy are a TbNdPrBCu alloy, a TbNdCePrBCu alloy, a TbNdPrBCuFe alloy, a TbNdBGa alloy, a TbNdPrBGaCu alloy, a TbNdBGaCuFe alloy, an NdPrTbBCuGaAl alloy, and the like.

In addition to the above-described elements, a small amount of element such as an unavoidable impurity, for example, Mn, O, C, N or the like may be contained. For example, Fe—B or $B_4C$ may be used as a source of B, so that C may be contained.

In the case where the content of RL+RH is lower than 50 mass %, it is difficult for RH, B and M to be introduced into the sintered R-T-B based magnet work, which may decrease the $H_cJ$. In the case where the content of RL+RH is higher than 95 mass %, the powder of the alloy becomes very active during the formation of the RL-RH-B-M based alloy, and as a result, may be oxidized significantly or burn. Preferably, the content of RL+RH is not lower than 70 mass % and not higher than 80 mass % of the entirety of the RL-RH-B-M based alloy. With such a content, higher $H_{cJ}$ is provided.

In the case where the content of RH is higher than 45 mass %, it is impossible to provide an sintered R-T-B based magnet having a good balance of the $B_r$ and the $H_{cJ}$ with the amount of use of a heavy rare-earth element, which is rare, being decreased. Preferably, the content of RH is not higher than 20 mass % of the entirety of the RL-RH-B-M based alloy. It is preferred that the total content of RL and RH is not lower than 55 mass % of the entirety of the RL-RH-B-M based alloy. With such a content, high $H_{cJ}$ is provided. Where the content (mass %) of RL in the RL-RH-B-M based alloy is [RL] and the content (mass %) of RH in the RL-RH-B-M based alloy is [RH], it is preferred that [RL]>1.5×[RH] is satisfied. This way, a sintered R-T-B based magnet having a good balance of the $B_r$ and the $H_{cJ}$ is provided with the amount of use of a heavy rare-earth element being further decreased.

In the case where the content of B is lower than 0.1 mass %, the volumetric ratio of the main phase in the vicinity of the surface of the magnet may not be suppressed from being decreased. In the case where the content of B is higher than 3.0 mass o, the effect of improving the $H_{cJ}$ by RL and B may be decreased. Preferably, the content of B is not lower than 0.5 mass % and not higher than 2.0 mass % of the entirety of the RL-RH-B-M based alloy. With such a content, a sintered R-T-B based magnet having a better balance of the $B_r$ and the $H_{cJ}$ is provided.

In the case where the content of M is lower than 4 mass %, it is difficult for RL, B and RH to be introduced into the intergranular grain boundary phase, which may not improve the $H_{cJ}$. In the case where the content of M is higher than 49.9 mass %, the $H_{cJ}$ may not be sufficiently improved because of the decrease in the contents of RL and B. Preferably, the content of M is not lower than 7 mass % and not higher than 15 mass % of the entirety of the RL-RH-B-M based alloy. With such a content, higher $H_{cJ}$ is provided. Preferably, M in the RL-RH-B-M based alloy contains, with no exception, at least one of Cu, Ga and Fe, and the total content of Cu, Ga and Fe in M is not lower than 80 mass %. With such a content, higher $H_{cJ}$ is provided.

There is no specific limitation on the method for forming the RL-RH-B-M based alloy. The RL-RH-B-M based alloy may be formed by a roll quenching method or a casting method. The alloy may be pulverized into alloy power. The RL-RH-B-M based alloy may be formed by a known atomization method such as a centrifugal atomization method, a rotary electrode method, a gas atomization method, a plasma atomization method, or the like.

(Diffusion Step)

The diffusion step is performed of heating the sintered R-T-B based magnet work and the RL-RH-B-M based alloy at a temperature not lower than 700° C. and not higher than 1100° C. in a vacuum or an inert gas atmosphere while at least a portion of the RL-RH-B-M based alloy is attached to at least a portion of a surface of the sintered R-T-B based magnet work. As a result, a liquid phase containing RL, B, (RH) and M is generated from the RL-RH-B-M based alloy, and the liquid phase is introduced from the surface into the interior of the sintered R-T-B based magnet work through diffusion, via grain boundaries in the sintered R-T-B based magnet work. The amount of the RL-RH-B-M based alloy attached to the sintered R-T-B based magnet work is preferably not lower than 1 mass % and not higher than 8 mass %, and is more preferably not lower than 1 mass % and not higher than 5 mass %. With such a range, a sintered R-T-B based magnet having high $H_{cJ}$ is provided with the amount of use of a heavy rear-earth element being decreased with more certainty.

In the diffusion step, it is preferred that the sintered R-T-B based magnet work and the RL-RH-B-M based alloy are heated at a heating temperature not lower than 700° C. and not higher than 1100° C. In the case where the heating temperature is lower than 700° C., high $H_{cJ}$ may not be provided. By contrast, in the case where the heating temperature is higher than 1100° C., the $H_{cJ}$ may be decreased significantly. Preferably, the heating temperature in the diffusion step is not lower than 800° C. and not higher than 1000° C. With such a range, higher $H_{cJ}$ is provided. It is preferred that the sintered R-T-B based magnet provided as a result of the diffusion step (not lower than 700° C. and not higher than 1100° C.) is cooled down to 300° C. at a cooling rate of at least 15° C./min. from the temperature at which the diffusion step is performed. With such an arrangement, higher $H_{cJ}$ is provided.

The diffusion step may be performed by use of a known heat treatment apparatus on an RL-RH-B-M based alloy of an arbitrary shape located on the surface of the sintered R-T-B based magnet work. For example, the diffusion step may be performed while the surface of the sintered R-T-B based magnet work is covered with a powder layer of the RL-RH-B-M based alloy. For example, an application step of applying an adhesive to the surface of a target of application and a step of attaching the RL-RH-B-M based alloy to a region of the surface having the adhesive applied thereto may be performed. Examples of the adhesive include PVA (polyvinylalcohol), PVB (polyvinylbutyral), PVP (polyvinylpyrrolidone), and the like. In the case where the adhesive is an aqueous adhesive, the sintered R-T-B based magnet work may be pre-heated before the application step. The pre-heating have purposes of removing an extra portion of the solvent to control the adhesive force, and attaching the adhesive uniformly. The heating temperature is preferably 60° to 200° C. In the case where the adhesive is a highly volatile organic solvent-based adhesive, this step may be omitted. Alternatively, for example, a slurry having the RL-RH-B-M based alloy dispersed in a dispersion medium may be applied on the surface of the sintered R-T-B based magnet work, and then the dispersion medium may be evaporated to allow the RL-RH-B-M based alloy to come into contact with the sintered R-T-B based magnet work. Examples of the dispersion medium include alcohols (ethanol, etc.), aldehydes, and ketones.

As long as at least a portion of the RL-RH-B-M based alloy is attached to at least a portion of the sintered R-T-B based magnet work, there is no limit on the position thereof.

(Heat Treatment Step)

Preferably, as shown in FIG. 2, heat treatment is performed to the sintered R-T-B based magnet provided as a result of the diffusion step, at a temperature that is not lower than 400° C. and not higher than 900° C. and is lower than the temperature at which the diffusion step is performed, in a vacuum or an inert gas atmosphere. The heat treatment may be performed a plurality of times. The heat treatment allows high $H_{cJ}$ to be provided.

(Sintered R-T-B Based Magnet)

The sintered R-T-B based magnet provided by the production method according to the present disclosure contains R (R is a rare-earth element and contains, with no exception, at least one selected from the group consisting of Nd, Pr and Ce), T (T is at least one selected from the group consisting of Fe, Co, Al, Mn and Si, and contains Fe with no exception), B, and at least one selected from the group consisting of Cu, Ga, Ni, Ag, Zn and Sn. The molar ratio [T]/[B] of T with respect to B in the surface region of the magnet, is lower than the molar ratio [T]/[B] of T with respect to B in the central region of the magnet. The sintered R-T-B based magnet according to the present disclosure includes a portion in which a concentration of B gradually decreases from the surface toward the interior of the magnet.

The sintered R-T-B based magnet according to the present disclosure may have, for example, the following composition.

R: not lower than 26.8 mass % and not higher than 31.5 mass %

B: not lower than 0.90 mass % and not higher than 0.97 mass %

M: not lower than 0.05 mass % and not higher than 1.0 mass % (M is at least one selected from the group consisting of Ga, Cu, Zn and Si)

M1: not lower than 0 mass % and not higher than 2.0 mass % (M1 is at least one selected from the group consisting of Al, Ti, V, Cr, Mn, Ni, Zr, Nb, Mo, Ag, In, Sn, Hf, Ta, W, Pb and Bi) Remaining part T (T is Fe, or Fe and Co), and unavoidable impurities.

The present disclosure provides a sintered R-T-B based magnet having a good balance of the $B_r$ and the $H_{cJ}$ with the amount of use of a heavy rare-earth element being decreased. Therefore, the content of, particularly, Tb with respect to the entirety of the sintered R-T-B based magnet is preferably lower than 5 mass % (including 0 mass %), more preferably not higher than 1 mass %, and still more preferably not higher than 0.5 mass %.

In the present disclosure, the "surface region of the magnet" refers to a region within a depth of 300 μm from the outermost surface of the sintered R-T-B based magnet. The "central region of the magnet" refers to a portion at the center of the sintered R-T-B based magnet.

The condition that the molar ratio [T]/[B] of T with respect to B in the surface region of the magnet is lower than the molar ratio [T]/[B] of T with respect to B in the central region of the magnet indicates that the B amount is larger in the surface region of the magnet than in the central region of the magnet. With the arrangement by which the molar ratio [T]/[B] of T with respect to B in the surface region of the magnet is lower than the molar ratio [T]/[B] of T with respect to B in the central region of the magnet, the volumetric ratio of the main phase in the surface region of the magnet is suppressed from being decreased due to the diffusion. Therefore, a sintered R-T-B based magnet having a good balance of the $B_r$ and the $H_{cJ}$ is provided. Preferably, the molar ratio [T]/[B] of T with respect to B in the surface region of the magnet is lower, by 0.2 or more, than the molar ratio [T]/[B] of T with respect to B in the central region of the magnet. With such an arrangement, a sintered R-T-B based magnet having a better balance of the Brand the $H_{cJ}$ is provided. More preferably, the molar ratio [T]/[B] of T with respect to B in the surface region of the magnet is lower, by 0.4 or more, than the molar ratio [T]/[B] of T with respect to B in the central region of the magnet. With such an arrangement, a sintered R-T-B based magnet having a better balance of the $B_r$ and the $H_{cJ}$ is provided with more certainty. In the case where the molar ratio [T]/[B] of T with respect to B in the surface region of the magnet is lower, by more than 3.0, than the molar ratio [T]/[B] of T with respect to B in the central region of the magnet, the $H_{cJ}$ may be decreased. Therefore, it is preferred that the molar ratio [T]/[B] of T with respect to B in the surface region of the magnet is lower, by not less than 0.2 and not more than 3.0 (more preferably, not less than 0.4 and not more than 3.0), than the molar ratio [T]/[B] of T with respect to B in the central region of the magnet.

The structure in which the sintered R-T-B based magnet includes a portion in which the concentration of B gradually decreases from the surface toward the interior of the magnet indicates that B is diffused from the surface toward the interior of the magnet. Such a state may be confirmed by, for example, cutting out a piece having a size of, for example, 1×1×1 mm, from the surface region and the interior of the magnet and performing component analysis by use of Inductively Coupled Plasma Optical Emission Spectrometry (ICP-OES).

The sintered R-T-B based magnet according to the present disclosure may include a portion in which a concentration of RH (e.g., Tb) gradually decreases from the surface toward the interior of the magnet. The structure in which the sintered R-T-B based magnet includes a portion in which the concentration of RH gradually decreases from the surface toward the interior of the magnet indicates that RH is diffused from the surface toward the interior of the magnet. Whether the sintered R-T-B based magnet includes a portion in which the concentration of RH gradually decreases from the surface toward the interior of the magnet may be checked by the method described above regarding the gradual decrease in the concentration of B.

EXAMPLES

The present invention will be described further by way of examples. The present invention is not limited to any of the following examples.

Experiment Example 1 [Step of Preparing Sintered R-T-B Based Magnet Works (Magnet Works)]

The raw materials were weighed such that the sintered R-T-B based magnet works would have the compositions (excluding the unavoidable impurities) shown in Nos. 1-A through 1-D in Table 1, and were cast by a strip casting method. As a result, raw material alloys in a flake form each having a thickness of 0.2 to 0.4 mm were obtained. The resultant raw material alloys in the flake form were each hydrogen-pulverized and then dehydrogenated, more specifically, heated to 550° C. and then cooled in a vacuum, to obtain a coarse-pulverized powder. Next, the resultant coarse-pulverized powder was pulverized by use of an airflow crusher (jet mill) to obtain a fine-pulverized powder (alloy powder) having a particle size $D_{50}$ of 3 μm. The particle size $D_{50}$ is a central value of volume (volume-based median diameter) obtained by an airflow-dispersion laser diffraction method.

The resultant fine-pulverized powder was pressed in a magnetic field to obtain a powder compact. As a pressing apparatus, a so-called orthogonal magnetic field pressing apparatus (transverse magnetic field pressing apparatus) was used, by which the direction of magnetic field application was orthogonal to the pressurizing direction.

The resultant powder compact was sintered at a temperature not lower than 1000° C. and not higher than 1050° C. (a temperature at which a sufficiently dense texture would result through sintering was selected for each of the sintered R-T-B based magnet works) for 4 hours in a vacuum and then quenched to obtain a magnet work. The resultant magnet works each had a density not lower than 7.5 $Mg/m^3$. Measurement results on the components of the resultant magnet works are shown in Table 1. The content of each of the components in Table 1 was measured by using Inductively Coupled Plasma Optical Emission Spectroscopy (ICP-OES). The amount of oxygen in each of all the magnet works was measured by a gas fusion infrared absorption method, and was confirmed to be about 0.2 mass %. The amount of C (carbon) in each of the magnet works was measured by a combustion infrared absorption method by use of a gas analyzer, and was confirmed to be about 0.1 mass %. Referring to Table 1, "[T]/[B]" was found as follows. The analysis value (mass %) of each of the elements contained in T (in this example, Fe, Al, Si and Mn) was divided by the molecular weight of the respective element, and a total value of such analysis values was set as (a). The analysis value (mass %) of B was divided by the molecular weight of B, and the resultant value was set as (b). [T]/[B] is the ratio of such values, i.e., (a/b). The same is applicable to all the other tables. A total of the contents of the elements in Table 1 and the amounts of oxygen and carbon is not 100 mass %. A reason for this is that the sintered R-T-B based magnet works each contain impurities other than the elements shown in Table 1. This is also applicable to all the other tables.

TABLE 1

| | COMPOSITION OF SINTERED R-T-B BASED MAGNET WORK (mass %) | | | | | | | | | | |
|---|---|---|---|---|---|---|---|---|---|---|---|
| | R | | T | | | | | B | | | [T]/ |
| No. | Nd | Pr | Fe | Co | Al | Mn | Si | B | Cu | Ga | [B] |
| 1-A | 23.4 | 5.6 | 68.4 | 0.49 | 0.10 | 0.03 | 0.03 | 0.93 | 0.01 | 0.30 | 14.4 |
| 1-B | 23.4 | 5.6 | 68.4 | 0.49 | 0.10 | 0.03 | 0.03 | 0.91 | 0.01 | 0.31 | 14.7 |
| 1-C | 23.5 | 5.6 | 68.4 | 0.49 | 0.10 | 0.03 | 0.04 | 0.90 | 0.01 | 0.31 | 14.9 |
| 1-D | 23.4 | 5.5 | 68.4 | 0.49 | 0.11 | 0.03 | 0.04 | 0.89 | 0.01 | 0.31 | 15.1 |

[Step of Preparing RL-RH-B-M Based Alloys]

The raw materials were weighed such that the RL-RH-B-M based alloys (including an alloy that does not include B) would have the compositions shown in Nos. 1-a through 1-f in Table 2, and were melted, to obtain alloys in a ribbon or flake form by a single roll rapid quenching method (melt spinning method). The resultant alloys were each pulverized in an argon atmosphere in a mortar to prepare an RL-RH-B-M based alloy. Table 2 shows the compositions of the resultant RL-RH-B-M based alloys.

TABLE 2

| | COMPOSITON OF RL-RH-B-M BASED ALLOY (mass %) | | | | | | | | |
|---|---|---|---|---|---|---|---|---|---|
| | RL | | RH | | B | M | | | |
| No. | Nd | Pr | Tb | Dy | B | Cu | Ga | Fe | Al |
| 1-a | 0.4 | 79.1 | 10.1 | 0.0 | 0.00 | 2.73 | 6.56 | — | 0.01 |
| 1-b | 0.3 | 68.0 | 11.6 | 0.0 | 2.06 | 2.53 | 6.10 | 7.58 | 0.01 |
| 1-c | 0.3 | 63.1 | 10.9 | 0.0 | 3.55 | 2.21 | 5.53 | 12.90 | 0.02 |
| 1-d | 0.3 | 79.0 | 10.1 | 0.0 | 0.32 | 2.64 | 6.88 | — | 0.01 |
| 1-e | 0.3 | 78.5 | 10.1 | 0.0 | 0.82 | 2.60 | 6.80 | — | 0.00 |
| 1-f | 0.3 | 77.5 | 10.2 | 0.0 | 1.76 | 2.49 | 6.58 | — | 0.00 |

[Diffusion Step]

The sintered R-T-B based magnet works of Nos. 1-A through 1-D in Table 1 were each cut and ground into a 7.2 mm×7.2 mm×7.2 mm cube. Next, an adhesive containing sugar alcohol was applied to the entire surface of each of the sintered R-T-B based magnet works by a dipping method. A powder of each of the RL-RH-B-M based alloys was applied to the corresponding sintered R-T-B based magnet work having the adhesive applied thereto at a ratio of 3 mass % with respect to the mass of the sintered R-T-B based magnet work. Next, the diffusion step was performed, in which the RL-RH-B-M based alloy and the sintered R-T-B based magnet work were heated at 900° C. for 10 hours in a vacuum heat treatment furnace. Then, the resultant substance was cooled to obtain a sintered R-T-B based magnet. The resultant sintered R-T-B based magnet was heated at a temperature not lower than 470° C. and not higher than 530° C. for 3 hours in a vacuum heat treatment furnace, and then cooled.

[Evaluation of Samples]

The $B_r$ and the $H_{cJ}$ of each of the sintered R-T-B based magnet works and each of the resultant samples (post-heat treatment sintered R-T-B based magnets) were measured by a B-H tracer. Table 3 shows the results of measurement of the $B_r$ and the $H_{cJ}$ of each of the magnet works and each of the sintered R-T-B based magnets, and $\Delta B_r$ of each of the sintered R-T-B based magnets. For each of the sintered R-T-B based magnets, $\Delta B_r$ was obtained by subtracting the value of $B_r$ of the sintered R-T-B based magnet work (pre-diffusion Br) from the value of $B_r$ of the sintered R-T-B based magnet (post-diffusion $B_r$). The components of the samples were measured by use of Inductively Coupled Plasma Optical Emission Spectrometry (ICP-OES). The results are shown in Table 4. Referring to Table 3, in comparative example samples Nos. 1-5 through 1-8, the alloy not containing B was diffused in Nos. 1-A through 1-D of the sintered R-T-B based magnet works. As seen from Table 3, in each of the comparative example samples, high $H_{cJ}$ is obtained but the $B_r$ is significantly decreased. In example samples Nos. 1-9 through 1-12 and 1-17 through 1-22, the RL-RH-B-M based alloys were diffused in Nos. 1-A through 1-D of the sintered R-T-B based magnet works. As seen from Table 3, in contrast to the comparative example samples, in each of the example samples, high $H_{cJ}$ is obtained in the diffusion step and the decrease in the $B_r$ is very little. As can be seen, sintered R-T-B based magnets having a good balance of the $B_r$ and the $H_{cJ}$ (having high $H_{cJ}$ with a suppressed decrease in the Br) are obtained. In comparative example samples Nos. 1-13 through 1-16, the content of B in the RL-RH-B-M based alloy was not in an appropriate range. As seen from Table 3, in each of these comparative example samples, the decrease in the $B_r$ is little but sufficiently high $H_{cJ}$ is not obtained.

A piece having a size of 1×1×1 mm was cut out from the surface region and the interior of the magnet of each of the samples, and [T]/[B] and the gradual decreases in the concentration of B and the concentration of RH were checked by use of Inductively Coupled Plasma Optical Emission Spectrometry (ICP-OES). The results are shown in Table 3. As described above, in comparative example samples Nos. 1-5 through 1-8, the alloy not containing B was diffused. In samples Nos. 1-9 through 1-22, the RL-RH-B-M based alloy was diffused. As seen from Table 3, in contrast to the comparative example samples, in each of the example samples, [T]/[B] in the surface region of the magnet is lower, by 2.0 or more, than [T]/[B] in the interior of the magnet (central region of the magnet). As can be seen, the concentration of B gradually decreases.

TABLE 3

| SAMPLE No. | CONDITIONS FOR PRODUCTION: SINTERED R-T-B BASED MAGNET WORK No. | RL-RH-B-M BASED ALLOY No. | ATTACHED AMOUNT OF RL-RH-B-M BASED ALLOY (mass %) | DIFFUSION STEP | Br (T) | ΔBr (T) | HcJ (kA/m) |
|---|---|---|---|---|---|---|---|
| 1-1 | 1-A | — | — | — | 1.45 | — | — |
| 1-2 | 1-B | — | — | — | 1.43 | — | — |
| 1-3 | 1-C | — | — | — | 1.43 | — | — |
| 1-4 | 1-D | — | — | — | 1.43 | — | — |
| 1-5 | 1-A | 1-a | 3.2 | 900° C. × 10 h | 1.41 | −0.04 | 1964 |
| 1-6 | 1-B | 1-a | 3.1 | 900° C. × 10 h | 1.41 | −0.03 | 2001 |
| 1-7 | 1-C | 1-a | 3.0 | 900° C. × 10 h | 1.39 | −0.04 | 1961 |
| 1-8 | 1-D | 1-a | 2.9 | 900° C. × 10 h | 1.38 | −0.04 | 1869 |
| 1-9 | 1-A | 1-b | 2.8 | 900° C. × 10 h | 1.45 | 0.00 | 1946 |
| 1-10 | 1-B | 1-b | 2.9 | 900° C. × 10 h | 1.44 | 0.00 | 2003 |
| 1-11 | 1-C | 1-b | 2.8 | 900° C. × 10 h | 1.42 | −0.01 | 2015 |
| 1-12 | 1-D | 1-b | 3.0 | 900° C. × 10 h | 1.40 | −0.02 | 2004 |
| 1-13 | 1-A | 1-c | 2.8 | 900° C. × 10 h | 1.45 | −0.01 | 1353 |
| 1-14 | 1-B | 1-c | 2.8 | 900° C. × 10 h | 1.44 | 0.00 | 1566 |
| 1-15 | 1-C | 1-c | 2.8 | 900° C. × 10 h | 1.42 | −0.01 | 1639 |
| 1-16 | 1-D | 1-c | 3.0 | 900° C. × 10 h | 1.41 | −0.01 | 1532 |
| 1-17 | 1-B | 1-d | 3.1 | 900° C. × 10 h | 1.43 | 0.00 | 1995 |
| 1-18 | 1-C | 1-d | 2.9 | 900° C. × 10 h | 1.41 | −0.02 | 2038 |
| 1-19 | 1-B | 1-e | 3.1 | 900° C. × 10 h | 1.42 | −0.01 | 1962 |
| 1-20 | 1-C | 1-e | 2.9 | 900° C. × 10 h | 1.44 | 0.01 | 1865 |
| 1-21 | 1-B | 1-f | 3.1 | 900° C. × 10 h | 1.42 | −0.02 | 2002 |
| 1-22 | 1-C | 1-f | 2.9 | 900° C. × 10 h | 1.42 | −0.01 | 1903 |

| SAMPLE No. | SURFACE REGION OF MAGNET [T]/[B] | CENTRAL REGION OF MAGNET [T]/[B] | GRADUAL DECREASE IN B CONCEN-TRATION | GRADUAL DECREASE IN RH CONCEN-TRATION | REMARKS |
|---|---|---|---|---|---|
| 1-1 | — | — | — | — | COMPARATIVE EX |
| 1-2 | — | — | — | — | COMPARATIVE EX |
| 1-3 | — | — | — | — | COMPARATIVE EX |
| 1-4 | — | — | — | — | COMPARATIVE EX |
| 1-5 | 14.6 | 14.6 | x | ○ | COMPARATIVE EX |
| 1-6 | 14.9 | 15.0 | x | ○ | COMPARATIVE EX |
| 1-7 | 15.0 | 15.1 | x | ○ | COMPARATIVE EX |
| 1-8 | 15.5 | 15.5 | x | ○ | COMPARATIVE EX |
| 1-9 | 14.1 | 14.4 | ○ | ○ | EXAMPLE |
| 1-10 | 14.0 | 14.5 | ○ | ○ | EXAMPLE |
| 1-11 | 14.3 | 15.2 | ○ | ○ | EXAMPLE |
| 1-12 | 14.5 | 15.4 | ○ | ○ | EXAMPLE |
| 1-13 | 14.8 | 14.8 | ○ | ○ | COMPARATIVE EX |
| 1-14 | 14.7 | 14.9 | ○ | ○ | COMPARATIVE EX |
| 1-15 | 15.1 | 15.5 | ○ | ○ | COMPARATIVE EX |
| 1-16 | 15.3 | 15.4 | ○ | ○ | COMPARATIVE EX |
| 1-17 | 15.1 | 15.7 | ○ | ○ | EXAMPLE |
| 1-18 | 15.3 | 15.8 | ○ | ○ | EXAMPLE |
| 1-19 | 15.0 | 15.3 | ○ | ○ | EXAMPLE |
| 1-20 | 14.9 | 15.3 | ○ | ○ | EXAMPLE |
| 1-21 | 14.8 | 15.2 | ○ | ○ | EXAMPLE |
| 1-22 | 15.0 | 15.6 | ○ | ○ | EXAMPLE |

TABLE 4

| SAMPLE No. | RESULTS OF COMPONENT ANALYSIS: Nd | Pr | Tb | Dy | Fe | Co | Al | Mn | Si | B | Cu | Ga |
|---|---|---|---|---|---|---|---|---|---|---|---|---|
| 1-5 | 22.7 | 7.1 | 0.18 | 0.0 | 66.6 | 0.47 | 0.10 | 0.03 | 0.02 | 0.91 | 0.08 | 0.45 |
| 1-6 | 22.8 | 7.1 | 0.18 | 0.0 | 66.5 | 0.47 | 0.10 | 0.03 | 0.02 | 0.90 | 0.08 | 0.45 |
| 1-7 | 22.9 | 7.3 | 0.21 | 0.0 | 66.2 | 0.47 | 0.11 | 0.03 | 0.02 | 0.88 | 0.09 | 0.48 |
| 1-8 | 22.9 | 7.3 | 0.20 | 0.0 | 66.3 | 0.47 | 0.11 | 0.03 | 0.02 | 0.87 | 0.09 | 0.47 |
| 1-9 | 22.8 | 6.8 | 0.18 | 0.0 | 67.0 | 0.48 | 0.10 | 0.03 | 0.03 | 0.94 | 0.07 | 0.43 |
| 1-10 | 22.8 | 6.9 | 0.19 | 0.0 | 66.7 | 0.47 | 0.10 | 0.03 | 0.03 | 0.93 | 0.07 | 0.44 |
| 1-11 | 22.9 | 6.9 | 0.19 | 0.0 | 66.5 | 0.48 | 0.10 | 0.03 | 0.03 | 0.91 | 0.07 | 0.45 |
| 1-12 | 22.9 | 7.0 | 0.18 | 0.0 | 66.4 | 0.48 | 0.11 | 0.03 | 0.04 | 0.90 | 0.08 | 0.47 |
| 1-13 | 23.2 | 6.1 | 0.04 | 0.0 | 67.5 | 0.48 | 0.10 | 0.03 | 0.03 | 0.93 | 0.04 | 0.36 |
| 1-14 | 23.1 | 6.2 | 0.05 | 0.0 | 67.3 | 0.48 | 0.10 | 0.03 | 0.03 | 0.91 | 0.05 | 0.38 |

TABLE 4-continued

| SAMPLE | RESULTS OF COMPONENT ANALYSIS | | | | | | | | | | | |
|---|---|---|---|---|---|---|---|---|---|---|---|---|
| No. | Nd | Pr | Tb | Dy | Fe | Co | Al | Mn | Si | B | Cu | Ga |
| 1-15 | 23.2 | 6.2 | 0.06 | 0.0 | 67.3 | 0.48 | 0.10 | 0.03 | 0.03 | 0.90 | 0.05 | 0.38 |
| 1-16 | 23.1 | 6.2 | 0.06 | 0.0 | 67.2 | 0.47 | 0.10 | 0.03 | 0.03 | 0.88 | 0.05 | 0.38 |
| 1-17 | 23.0 | 7.2 | 0.18 | 0.0 | 67.4 | 0.48 | 0.08 | 0.03 | 0.04 | 0.91 | 0.08 | 0.47 |
| 1-18 | 23.0 | 7.3 | 0.19 | 0.0 | 67.3 | 0.48 | 0.08 | 0.03 | 0.04 | 0.89 | 0.08 | 0.49 |
| 1-19 | 22.8 | 7.0 | 0.16 | 0.0 | 67.7 | 0.48 | 0.08 | 0.03 | 0.04 | 0.93 | 0.07 | 0.46 |
| 1-20 | 22.9 | 7.1 | 0.16 | 0.0 | 67.6 | 0.48 | 0.08 | 0.03 | 0.04 | 0.91 | 0.08 | 0.48 |
| 1-21 | 22.9 | 6.8 | 0.12 | 0.0 | 67.9 | 0.48 | 0.08 | 0.03 | 0.05 | 0.93 | 0.07 | 0.46 |
| 1-22 | 23.0 | 6.9 | 0.12 | 0.0 | 67.7 | 0.48 | 0.08 | 0.03 | 0.05 | 0.92 | 0.07 | 0.48 |

Experiment Example 2 [Step of Preparing Sintered R-T-B Based Magnet Works (Magnet Works)]

The raw materials were weighed such that the sintered R-T-B based magnet works would have the compositions shown in Nos. 2-A through 2-L in Table 5, and were cast by a strip casting method. As a result, raw material alloys in a flake form each having a thickness of 0.2 to 0.4 mm were obtained. The resultant raw material alloys in the flake form were each hydrogen-pulverized and then dehydrogenated, more specifically, heated to 550° C. and then cooled in a vacuum, to obtain a coarse-pulverized powder. Next, the resultant coarse-pulverized powder was pulverized by use of an airflow crusher (jet mill) to obtain a fine-pulverized powder (alloy powder) having a particle size $D_{50}$ of 3 μm. The particle size $D_{50}$ is a central value of volume (volume-based median diameter) obtained by an airflow-dispersion laser diffraction method.

The resultant fine-pulverized powder was pressed in a magnetic field to obtain a compact. As a pressing apparatus, a so-called orthogonal magnetic field pressing apparatus (transverse magnetic field pressing apparatus) was used, by which the direction of magnetic field application was orthogonal to the pressurizing direction.

The resultant compact was sintered at a temperature not lower than 1000° C. and not higher than 1050° C. (a temperature at which a sufficiently dense texture would result through sintering was selected for each of the sintered R-T-B based magnet works) for 10 hours in a vacuum and then quenched to obtain a magnet work. The resultant magnet works each had a density not lower than 7.5 $Mg/m^3$. Measurement results on the components of the resultant magnet works are shown in Table 5. The content of each of the components in Table 5 was measured by using Inductively Coupled Plasma Optical Emission Spectroscopy (ICP-OES). The amount of oxygen in each of all the magnet works was measured by a gas fusion infrared absorption method, and was confirmed to be about 0.2 mass %. The amount of C (carbon) in each of the magnet works was measured by a combustion infrared absorption method by use of a gas analyzer, and was confirmed to be about 0.1 mass %.

TABLE 5

| | COMPOSITION OF SINTERED R-T-B BASED MAGNET WORK (mass %) | | | | | | | | | | | | |
|---|---|---|---|---|---|---|---|---|---|---|---|---|---|
| | R | | | T | | | | | B | | | | [T]/ |
| No. | Nd | Pr | Dy | Fe | Co | Al | Mn | Si | B | Cu | Ga | Zr | [B] |
| 2-A | 22.7 | 5.5 | 0.3 | 69.4 | 0.49 | 0.08 | 0.04 | 0.04 | 0.94 | 0.01 | 0.31 | 0.05 | 14.4 |
| 2-B | 22.7 | 5.4 | 0.3 | 69.5 | 0.49 | 0.07 | 0.04 | 0.04 | 0.92 | 0.01 | 0.31 | 0.05 | 14.8 |
| 2-C | 22.7 | 5.5 | 0.3 | 69.3 | 0.48 | 0.07 | 0.04 | 0.04 | 0.91 | 0.01 | 0.31 | 0.05 | 14.9 |
| 2-D | 22.7 | 5.5 | 0.3 | 69.5 | 0.48 | 0.07 | 0.04 | 0.04 | 0.90 | 0.01 | 0.31 | 0.05 | 15.2 |
| 2-E | 22.9 | 5.5 | 0.3 | 69.0 | 0.48 | 0.08 | 0.04 | 0.04 | 0.94 | 0.01 | 0.31 | 0.00 | 14.4 |
| 2-F | 22.9 | 5.5 | 0.3 | 68.9 | 0.48 | 0.08 | 0.04 | 0.04 | 0.92 | 0.01 | 0.31 | 0.00 | 14.7 |
| 2-G | 23.1 | 5.6 | 0.3 | 68.9 | 0.48 | 0.08 | 0.04 | 0.04 | 0.91 | 0.01 | 0.31 | 0.00 | 14.9 |
| 2-H | 23.1 | 5.6 | 0.3 | 68.9 | 0.48 | 0.08 | 0.04 | 0.04 | 0.89 | 0.01 | 0.31 | 0.00 | 15.2 |
| 2-I | 23.0 | 5.5 | 0.3 | 68.9 | 0.48 | 0.09 | 0.04 | 0.03 | 0.93 | 0.01 | 0.31 | 0.05 | 14.4 |
| 2-J | 23.0 | 5.5 | 0.3 | 69.0 | 0.48 | 0.08 | 0.04 | 0.03 | 0.92 | 0.01 | 0.31 | 0.05 | 14.7 |
| 2-K | 23.0 | 5.5 | 0.3 | 68.9 | 0.48 | 0.08 | 0.04 | 0.04 | 0.91 | 0.01 | 0.31 | 0.05 | 14.9 |
| 2-L | 23.1 | 5.5 | 0.3 | 69.1 | 0.48 | 0.08 | 0.04 | 0.03 | 0.89 | 0.01 | 0.31 | 0.05 | 15.2 |

[Step of Preparing RL-RH-B-M Based Alloys]

The raw materials were weighed such that the RL-RH-B-M based alloys (including an alloy that does not include B) would have the compositions shown in Nos. 2-a and 2-b in Table 6, and were melted, to obtain alloys in a ribbon or flake form by a single roll rapid quenching method (melt spinning method). The resultant alloys were each pulverized in an argon atmosphere in a mortar to prepare an RL-RH-B-M based alloy. Table 6 shows the compositions of the resultant RL-RH-B-M based alloys.

TABLE 6

| | COMPOSITON OF RL-RH-B-M BASED ALLOY (mass %) | | | | | | | | |
|---|---|---|---|---|---|---|---|---|---|
| | RL | | RH | | B | M | | | |
| No. | Nd | Pr | Tb | Dy | B | Cu | Ga | Fe | Al |
| 2-a | 0.3 | 79.3 | 10.2 | 0.0 | 0.00 | 2.63 | 6.90 | — | 0.00 |
| 2-b | 0.4 | 68.4 | 11.7 | 0.0 | 2.06 | 2.42 | 6.22 | 7.86 | 0.46 |

[Diffusion Step]

The sintered R-T-B based magnet works of Nos. 2-A through 2-L in Table 5 were each cut and ground into a 7.2 mm×7.2 mm×7.2 mm cube. Next, an adhesive containing sugar alcohol was applied to the entire surface of each of the sintered R-T-B based magnet works by a dipping method. A powder of each of the RL-RH-B-M based alloys was applied to the corresponding sintered R-T-B based magnet work having the adhesive applied thereto at a ratio of 2.4 mass % with respect to the mass of the sintered R-T-B based magnet work. Next, the diffusion step was performed, in which the RL-RH-B-M based alloy and the sintered R-T-B based magnet work were heated at 900° C. for 10 hours in a vacuum heat treatment furnace. Then, the resultant substance was cooled. After this, the resultant sintered R-T-B based magnet was heated at a temperature not lower than 470° C. and not higher than 530° C. for 3 hours in a vacuum heat treatment furnace, and then cooled.

[Evaluation of Samples]

The $B_r$ and the $H_{cJ}$ of each of the sintered R-T-B based magnet works and each of the resultant samples (post-heat treatment sintered R-T-B based magnets) were measured by a B-H tracer. Table 7 shows the results of measurement of the $B_r$ and the $H_{cJ}$ of each of the magnet works and each of the sintered R-T-B based magnets, and $\Delta B_r$ of each of the sintered R-T-B based magnets. For each of the sintered R-T-B based magnets, $\Delta B_r$ was obtained by subtracting the value of $B_r$ of the sintered R-T-B based magnet work (pre-diffusion $B_r$) from the value of $B_r$ of the sintered R-T-B based magnet (post-diffusion $B_r$). The components of the samples were measured by use of Inductively Coupled Plasma Optical Emission Spectrometry (ICP-OES). The results are shown in Table 8. Referring to Table 7, in comparative example samples Nos. 2-5 through 2-8, 2-13 through 2-16, 2-25 through 2-28, 2-33 through 2-36, 2-45 through 2-48 and 2-53 through 2-56, the alloy not containing B was diffused. As seen from Table 7, in each of the comparative example samples, high $H_{cJ}$ is obtained but the $B_r$ is significantly decreased. In example samples Nos. 2-9 through 2-12, 2-17 through 2-20, 2-29 through 2-32, 2-37 through 2-40, 2-49 through 2-52 and 2-57 through 2-60, the RL-RH-B-M based alloys were diffused in Nos. 2-1 through 2-4, 2-21 through 2-24 and 2-41 through 2-44 of the sintered R-T-B based magnet works. As seen from Table 7, in contrast to the comparative example samples, in each of the example samples, high $H_{cJ}$ is obtained in the diffusion step and the decrease in the $B_r$ is very little. As can be seen, sintered R-T-B based magnets having a good balance of the $B_r$ and the $H_{cJ}$ are obtained.

TABLE 7

| | CONDITIONS FOR PRODUCTION | | | | | | | |
|---|---|---|---|---|---|---|---|---|
| SAMPLE No. | SINTERED R-T-B BASED MAGNET WORK No. | RL-RH-B-M BASED ALLOY No. | ATTACHED AMOUNT OF RL-RH-B-M BASED ALLOY (mass %) | DIFFUSION STEP | Br (T) | ΔBr (T) | HcJ (kA/m) | REMARKS |
| 2-1 | 2-A | — | — | — | 1.47 | — | — | COMPARATIVE EX |
| 2-2 | 2-B | — | — | — | 1.47 | — | — | COMPARATIVE EX |
| 2-3 | 2-C | — | — | — | 1.45 | — | — | COMPARATIVE EX |
| 2-4 | 2-D | — | — | — | 1.46 | — | — | COMPARATIVE EX |
| 2-5 | 2-A | 2-a | 3.0 | 900° C. × 10 h | 1.44 | −0.04 | 1980 | COMPARATIVE EX |
| 2-6 | 2-B | 2-a | 3.0 | 900° C. × 10 h | 1.42 | −0.05 | 2015 | COMPARATIVE EX |
| 2-7 | 2-C | 2-a | 3.1 | 900° C. × 10 h | 1.42 | −0.03 | 1979 | COMPARATIVE EX |
| 2-8 | 2-D | 2-a | 2.9 | 900° C. × 10 h | 1.41 | −0.05 | 1964 | COMPARATIVE EX |
| 2-9 | 2-A | 2-b | 2.9 | 900° C. × 10 h | 1.46 | −0.02 | 1933 | EXAMPLE |
| 2-10 | 2-B | 2-b | 2.9 | 900° C. × 10 h | 1.44 | −0.03 | 1987 | EXAMPLE |
| 2-11 | 2-C | 2-b | 3.0 | 900° C. × 10 h | 1.43 | −0.03 | 2026 | EXAMPLE |
| 2-12 | 2-D | 2-b | 3.1 | 900° C. × 10 h | 1.43 | −0.03 | 2000 | EXAMPLE |
| 2-13 | 2-A | 2-a | 4.4 | 900° C. × 10 h | 1.43 | −0.05 | 2071 | COMPARATIVE EX |
| 2-14 | 2-B | 2-a | 4.3 | 900° C. × 10 h | 1.42 | −0.05 | 2090 | COMPARATIVE EX |
| 2-15 | 2-C | 2-a | 4.4 | 900° C. × 10 h | 1.41 | −0.05 | 1988 | COMPARATIVE EX |
| 2-16 | 2-D | 2-a | 4.3 | 900° C. × 10 h | 1.40 | −0.06 | 1960 | COMPARATIVE EX |
| 2-17 | 2-A | 2-b | 4.3 | 900° C. × 10 h | 1.44 | −0.03 | 2042 | EXAMPLE |
| 2-18 | 2-B | 2-b | 4.4 | 900° C. × 10 h | 1.43 | −0.02 | 2098 | EXAMPLE |
| 2-19 | 2-C | 2-b | 4.4 | 900° C. × 10 h | 1.42 | −0.04 | 2100 | EXAMPLE |
| 2-20 | 2-D | 2-b | 4.4 | 900° C. × 10 h | 1.41 | −0.04 | 2087 | EXAMPLE |
| 2-21 | 2-E | — | — | — | 1.45 | — | — | COMPARATIVE EX |
| 2-22 | 2-F | — | — | — | 1.45 | — | — | COMPARATIVE EX |
| 2-23 | 2-G | — | — | — | 1.44 | — | — | COMPARATIVE EX |
| 2-24 | 2-H | — | — | — | 1.44 | — | — | COMPARATIVE EX |
| 2-25 | 2-E | 2-a | 2.9 | 900° C. × 10 h | 1.43 | −0.02 | 1963 | COMPARATIVE EX |
| 2-26 | 2-F | 2-a | 3.0 | 900° C. × 10 h | 1.41 | −0.04 | 2038 | COMPARATIVE EX |
| 2-27 | 2-G | 2-a | 3.0 | 900° C. × 10 h | 1.40 | −0.05 | 1981 | COMPARATIVE EX |
| 2-28 | 2-H | 2-a | 3.0 | 900° C. × 10 h | 1.38 | −0.06 | 1901 | COMPARATIVE EX |
| 2-29 | 2-E | 2-b | 2.9 | 900° C. × 10 h | 1.44 | −0.01 | 1988 | EXAMPLE |
| 2-30 | 2-F | 2-b | 3.0 | 900° C. × 10 h | 1.44 | −0.01 | 2048 | EXAMPLE |
| 2-31 | 2-G | 2-b | 3.1 | 900° C. × 10 h | 1.42 | −0.03 | 2098 | EXAMPLE |
| 2-32 | 2-H | 2-b | 3.1 | 900° C. × 10 h | 1.40 | −0.04 | 2094 | EXAMPLE |
| 2-33 | 2-E | 2-a | 4.4 | 900° C. × 10 h | 1.42 | −0.03 | 2089 | COMPARATIVE EX |
| 2-34 | 2-F | 2-a | 4.3 | 900° C. × 10 h | 1.40 | −0.05 | 2122 | COMPARATIVE EX |
| 2-35 | 2-G | 2-a | 4.4 | 900° C. × 10 h | 1.39 | −0.05 | 2041 | COMPARATIVE EX |
| 2-36 | 2-H | 2-a | 4.4 | 900° C. × 10 h | 1.38 | −0.06 | 1962 | COMPARATIVE EX |
| 2-37 | 2-E | 2-b | 4.4 | 900° C. × 10 h | 1.43 | −0.02 | 2098 | EXAMPLE |
| 2-38 | 2-F | 2-b | 4.3 | 900° C. × 10 h | 1.43 | −0.02 | 2130 | EXAMPLE |
| 2-39 | 2-G | 2-b | 4.3 | 900° C. × 10 h | 1.41 | −0.03 | 2138 | EXAMPLE |
| 2-40 | 2-H | 2-b | 4.4 | 900° C. × 10 h | 1.40 | −0.04 | 2144 | EXAMPLE |
| 2-41 | 2-I | — | — | — | 1.45 | — | — | COMPARATIVE EX |
| 2-42 | 2-J | — | — | — | 1.45 | — | — | COMPARATIVE EX |
| 2-43 | 2-K | — | — | — | 1.45 | — | — | COMPARATIVE EX |

TABLE 7-continued

| SAMPLE No. | CONDITIONS FOR PRODUCTION: SINTERED R-T-B BASED MAGNET WORK No. | RL-RH-B-M BASED ALLOY No. | ATTACHED AMOUNT OF RL-RH-B-M BASED ALLOY (mass %) | DIFFUSION STEP | Br (T) | ΔBr (T) | HcJ (kA/m) | REMARKS |
|---|---|---|---|---|---|---|---|---|
| 2-44 | 2-L | — | — | — | 1.45 | — | — | COMPARATIVE EX |
| 2-45 | 2-I | 2-a | 2.9 | 900° C. × 10 h | 1.42 | −0.04 | 1986 | COMPARATIVE EX |
| 2-46 | 2-J | 2-a | 2.9 | 900° C. × 10 h | 1.40 | −0.04 | 2029 | COMPARATIVE EX |
| 2-47 | 2-K | 2-a | 3.1 | 900° C. × 10 h | 1.39 | −0.06 | 2009 | COMPARATIVE EX |
| 2-48 | 2-L | 2-a | 3.1 | 900° C. × 10 h | 1.39 | −0.06 | 1918 | COMPARATIVE EX |
| 2-49 | 2-I | 2-b | 3.0 | 900° C. × 10 h | 1.44 | −0.01 | 2027 | EXAMPLE |
| 2-50 | 2-J | 2-b | 2.9 | 900° C. × 10 h | 1.43 | −0.02 | 2048 | EXAMPLE |
| 2-51 | 2-K | 2-b | 3.1 | 900° C. × 10 h | 1.42 | −0.04 | 2085 | EXAMPLE |
| 2-52 | 2-L | 2-b | 3.1 | 900° C. × 10 h | 1.41 | −0.04 | 2066 | EXAMPLE |
| 2-53 | 2-I | 2-a | 4.4 | 900° C. × 10 h | 1.42 | −0.04 | 2096 | COMPARATIVE EX |
| 2-54 | 2-J | 2-a | 4.2 | 900° C. × 10 h | 1.41 | −0.04 | 2112 | COMPARATIVE EX |
| 2-55 | 2-K | 2-a | 4.3 | 900° C. × 10 h | 1.40 | −0.06 | 2047 | COMPARATIVE EX |
| 2-56 | 2-L | 2-a | 4.3 | 900° C. × 10 h | 1.39 | −0.06 | 1957 | COMPARATIVE EX |
| 2-57 | 2-I | 2-b | 4.3 | 900° C. × 10 h | 1.42 | −0.03 | 2073 | EXAMPLE |
| 2-58 | 2-J | 2-b | 4.3 | 900° C. × 10 h | 1.43 | −0.02 | 2103 | EXAMPLE |
| 2-59 | 2-K | 2-b | 4.3 | 900° C. × 10 h | 1.41 | −0.04 | 2123 | EXAMPLE |
| 2-60 | 2-L | 2-b | 4.2 | 900° C. × 10 h | 1.39 | −0.06 | 2114 | EXAMPLE |

TABLE 8

| SAMPLE No. | RESULTS OF COMPONENT ANALYSIS: Nd | Pr | Tb | Dy | Fe | Co | Al | Mn | Si | B | Cu | Ga | Zr |
|---|---|---|---|---|---|---|---|---|---|---|---|---|---|
| 2-5 | 22.1 | 7.1 | 0.14 | 0.3 | 67.7 | 0.47 | 0.07 | 0.04 | 0.03 | 0.92 | 0.08 | 0.46 | 0.05 |
| 2-6 | 22.1 | 7.1 | 0.15 | 0.3 | 67.4 | 0.47 | 0.07 | 0.04 | 0.03 | 0.91 | 0.08 | 0.46 | 0.05 |
| 2-7 | 22.2 | 7.2 | 0.16 | 0.3 | 67.3 | 0.47 | 0.06 | 0.04 | 0.04 | 0.89 | 0.08 | 0.46 | 0.05 |
| 2-8 | 22.1 | 7.1 | 0.16 | 0.3 | 67.4 | 0.47 | 0.06 | 0.04 | 0.04 | 0.88 | 0.08 | 0.46 | 0.05 |
| 2-9 | 22.1 | 6.6 | 0.13 | 0.3 | 67.9 | 0.47 | 0.08 | 0.04 | 0.04 | 0.94 | 0.06 | 0.43 | 0.05 |
| 2-10 | 22.1 | 6.7 | 0.15 | 0.3 | 67.9 | 0.47 | 0.08 | 0.04 | 0.04 | 0.93 | 0.07 | 0.43 | 0.05 |
| 2-11 | 22.1 | 6.9 | 0.17 | 0.3 | 67.7 | 0.47 | 0.07 | 0.04 | 0.04 | 0.91 | 0.07 | 0.45 | 0.05 |
| 2-12 | 22.1 | 7.0 | 0.18 | 0.3 | 67.7 | 0.47 | 0.07 | 0.04 | 0.04 | 0.90 | 0.08 | 0.46 | 0.05 |
| 2-13 | 22.0 | 7.4 | 0.19 | 0.3 | 67.4 | 0.47 | 0.07 | 0.04 | 0.03 | 0.91 | 0.10 | 0.47 | 0.05 |
| 2-14 | 22.0 | 7.5 | 0.21 | 0.3 | 67.1 | 0.46 | 0.07 | 0.04 | 0.03 | 0.90 | 0.10 | 0.48 | 0.05 |
| 2-15 | 21.9 | 7.6 | 0.21 | 0.3 | 67.2 | 0.46 | 0.07 | 0.04 | 0.03 | 0.88 | 0.10 | 0.48 | 0.05 |
| 2-16 | 21.9 | 7.6 | 0.21 | 0.3 | 67.2 | 0.46 | 0.07 | 0.04 | 0.03 | 0.87 | 0.10 | 0.49 | 0.05 |
| 2-17 | 21.9 | 6.9 | 0.19 | 0.3 | 67.9 | 0.46 | 0.09 | 0.04 | 0.04 | 0.93 | 0.08 | 0.45 | 0.05 |
| 2-18 | 21.9 | 7.2 | 0.21 | 0.3 | 67.5 | 0.47 | 0.08 | 0.04 | 0.04 | 0.92 | 0.09 | 0.47 | 0.05 |
| 2-19 | 22.0 | 7.3 | 0.22 | 0.3 | 67.3 | 0.47 | 0.08 | 0.04 | 0.04 | 0.91 | 0.10 | 0.48 | 0.05 |
| 2-20 | 22.0 | 7.4 | 0.23 | 0.3 | 67.3 | 0.47 | 0.08 | 0.04 | 0.05 | 0.90 | 0.10 | 0.50 | 0.05 |
| 2-25 | 22.4 | 7.1 | 0.18 | 0.3 | 67.2 | 0.47 | 0.08 | 0.04 | 0.04 | 0.92 | 0.07 | 0.45 | 0.00 |
| 2-26 | 22.4 | 7.2 | 0.19 | 0.3 | 67.1 | 0.47 | 0.08 | 0.04 | 0.04 | 0.90 | 0.08 | 0.47 | 0.00 |
| 2-27 | 22.5 | 7.3 | 0.19 | 0.3 | 66.8 | 0.47 | 0.07 | 0.04 | 0.03 | 0.89 | 0.08 | 0.47 | 0.00 |
| 2-28 | 22.5 | 7.3 | 0.18 | 0.3 | 66.7 | 0.47 | 0.07 | 0.04 | 0.03 | 0.87 | 0.08 | 0.48 | 0.00 |
| 2-29 | 22.4 | 6.8 | 0.19 | 0.3 | 67.8 | 0.47 | 0.09 | 0.04 | 0.04 | 0.94 | 0.06 | 0.43 | 0.00 |
| 2-30 | 22.4 | 6.9 | 0.20 | 0.3 | 67.4 | 0.47 | 0.09 | 0.04 | 0.04 | 0.93 | 0.07 | 0.45 | 0.00 |
| 2-31 | 22.4 | 7.0 | 0.20 | 0.3 | 67.3 | 0.47 | 0.09 | 0.04 | 0.04 | 0.92 | 0.08 | 0.46 | 0.00 |
| 2-32 | 22.5 | 7.2 | 0.21 | 0.3 | 67.1 | 0.47 | 0.09 | 0.04 | 0.04 | 0.91 | 0.08 | 0.48 | 0.00 |
| 2-33 | 22.1 | 7.4 | 0.23 | 0.3 | 67.2 | 0.46 | 0.08 | 0.04 | 0.03 | 0.92 | 0.09 | 0.47 | 0.00 |
| 2-34 | 22.2 | 7.6 | 0.24 | 0.3 | 66.8 | 0.46 | 0.08 | 0.04 | 0.04 | 0.90 | 0.10 | 0.49 | 0.00 |
| 2-35 | 22.2 | 7.7 | 0.24 | 0.3 | 66.7 | 0.46 | 0.08 | 0.04 | 0.03 | 0.89 | 0.10 | 0.50 | 0.00 |
| 2-36 | 22.3 | 7.8 | 0.24 | 0.3 | 66.5 | 0.46 | 0.08 | 0.04 | 0.03 | 0.87 | 0.11 | 0.51 | 0.00 |
| 2-37 | 22.1 | 7.0 | 0.24 | 0.3 | 67.7 | 0.46 | 0.10 | 0.04 | 0.05 | 0.94 | 0.07 | 0.44 | 0.00 |
| 2-38 | 22.2 | 7.2 | 0.24 | 0.3 | 67.3 | 0.47 | 0.09 | 0.04 | 0.04 | 0.93 | 0.09 | 0.47 | 0.00 |
| 2-39 | 22.2 | 7.3 | 0.25 | 0.3 | 67.0 | 0.47 | 0.09 | 0.04 | 0.04 | 0.92 | 0.10 | 0.49 | 0.00 |
| 2-40 | 22.3 | 7.6 | 0.26 | 0.3 | 66.7 | 0.47 | 0.09 | 0.04 | 0.04 | 0.91 | 0.10 | 0.52 | 0.00 |
| 2-45 | 22.4 | 7.0 | 0.16 | 0.3 | 67.3 | 0.47 | 0.08 | 0.04 | 0.04 | 0.92 | 0.07 | 0.44 | 0.05 |
| 2-46 | 22.5 | 7.2 | 0.16 | 0.3 | 67.1 | 0.47 | 0.08 | 0.04 | 0.03 | 0.91 | 0.08 | 0.46 | 0.05 |
| 2-47 | 22.4 | 7.3 | 0.16 | 0.3 | 67.0 | 0.47 | 0.08 | 0.04 | 0.03 | 0.89 | 0.08 | 0.47 | 0.05 |
| 2-48 | 22.5 | 7.3 | 0.16 | 0.3 | 67.1 | 0.47 | 0.07 | 0.04 | 0.03 | 0.88 | 0.08 | 0.48 | 0.05 |
| 2-49 | 22.3 | 6.8 | 0.17 | 0.3 | 67.7 | 0.47 | 0.10 | 0.04 | 0.04 | 0.94 | 0.06 | 0.43 | 0.05 |
| 2-50 | 22.4 | 6.8 | 0.17 | 0.3 | 67.5 | 0.47 | 0.09 | 0.04 | 0.04 | 0.93 | 0.07 | 0.44 | 0.05 |
| 2-51 | 22.4 | 7.0 | 0.18 | 0.3 | 67.3 | 0.47 | 0.09 | 0.04 | 0.04 | 0.92 | 0.08 | 0.46 | 0.05 |
| 2-52 | 22.5 | 7.1 | 0.18 | 0.3 | 67.2 | 0.47 | 0.08 | 0.04 | 0.03 | 0.91 | 0.08 | 0.47 | 0.05 |
| 2-53 | 22.2 | 7.4 | 0.20 | 0.3 | 67.1 | 0.46 | 0.09 | 0.04 | 0.04 | 0.92 | 0.09 | 0.45 | 0.05 |
| 2-54 | 22.2 | 7.5 | 0.21 | 0.3 | 67.0 | 0.46 | 0.08 | 0.04 | 0.03 | 0.90 | 0.09 | 0.47 | 0.05 |
| 2-55 | 22.2 | 7.6 | 0.21 | 0.3 | 66.8 | 0.46 | 0.08 | 0.04 | 0.03 | 0.89 | 0.10 | 0.48 | 0.05 |
| 2-56 | 22.2 | 7.6 | 0.20 | 0.3 | 66.6 | 0.46 | 0.08 | 0.04 | 0.03 | 0.87 | 0.10 | 0.49 | 0.05 |

TABLE 8-continued

| SAMPLE | RESULTS OF COMPONENT ANALYSIS | | | | | | | | | | | | |
|---|---|---|---|---|---|---|---|---|---|---|---|---|---|
| No. | Nd | Pr | Tb | Dy | Fe | Co | Al | Mn | Si | B | Cu | Ga | Zr |
| 2-57 | 22.2 | 6.9 | 0.20 | 0.3 | 67.4 | 0.46 | 0.10 | 0.04 | 0.04 | 0.94 | 0.07 | 0.44 | 0.05 |
| 2-58 | 22.2 | 7.1 | 0.21 | 0.3 | 67.4 | 0.46 | 0.10 | 0.04 | 0.04 | 0.93 | 0.08 | 0.46 | 0.05 |
| 2-59 | 22.2 | 7.3 | 0.22 | 0.3 | 67.2 | 0.47 | 0.09 | 0.04 | 0.05 | 0.92 | 0.09 | 0.48 | 0.05 |
| 2-60 | 22.3 | 7.4 | 0.22 | 0.3 | 67.0 | 0.47 | 0.09 | 0.04 | 0.03 | 0.90 | 0.10 | 0.50 | 0.05 |

Experiment Example 3 [Step of Preparing Sintered R-T-B Based Magnet Works (Magnet Works)]

The raw materials were weighed such that the sintered R-T-B based magnet works would have the compositions shown in Nos. 3-A and 3-B in Table 9, and were cast by a strip casting method. As a result, raw material alloys in a flake form each having a thickness of 0.2 to 0.4 mm were obtained. The resultant raw material alloys in the flake form were each hydrogen-pulverized and then dehydrogenated, more specifically, heated to 550° C. and then cooled in a vacuum, to obtain a coarse-pulverized powder. Next, the resultant coarse-pulverized powder was pulverized by use of an airflow crusher (jet mill) to obtain a fine-pulverized powder (alloy powder) having a particle size $D_{50}$ of 3 μm. The particle size $D_{50}$ is a central value of volume (volume-based median diameter) obtained by an airflow-dispersion laser diffraction method.

The resultant fine-pulverized powder was pressed in a magnetic field to obtain a compact. As a pressing apparatus, a so-called orthogonal magnetic field pressing apparatus (transverse magnetic field pressing apparatus) was used, by which the direction of magnetic field application was orthogonal to the pressurizing direction.

The resultant compact was sintered at a temperature not lower than 1000° C. and not higher than 1050° C. (a temperature at which a sufficiently dense texture would result through sintering was selected for each of the sintered R-T-B based magnet works) for 10 hours in a vacuum and then quenched to obtain a magnet work. The resultant magnet works each had a density not lower than 7.5 $Mg/m^3$. Measurement results on the components of the resultant magnet works are shown in Table 9. The content of each of the components in Table 9 was measured by using Inductively Coupled Plasma Optical Emission Spectroscopy (ICP-OES). The amount of oxygen in each of all the magnet works was measured by a gas fusion infrared absorption method, and was confirmed to be about 0.2 mass %. The amount of C (carbon) in each of the magnet works was measured by a combustion infrared absorption method by use of a gas analyzer, and was confirmed to be about 0.1 mass %.

TABLE 9

| | COMPOSITION OF SINTERED R-T-B BASED MAGNET WORK (mass %) | | | | | | | | | | | | |
|---|---|---|---|---|---|---|---|---|---|---|---|---|---|
| | R | | | T | | | | | B | | | | [T]/ |
| No. | Nd | Pr | Dy | Fe | Co | Al | Mn | Si | B | Cu | Ga | Zr | [B] |
| 3-A | 22.7 | 5.5 | 0.3 | 69.4 | 0.49 | 0.08 | 0.04 | 0.04 | 0.94 | 0.01 | 0.31 | 0.05 | 14.4 |
| 3-B | 22.7 | 5.4 | 0.3 | 69.5 | 0.49 | 0.07 | 0.04 | 0.04 | 0.92 | 0.01 | 0.31 | 0.05 | 14.8 |

[Step of Preparing RL-RH-B-M Based Alloys]

The raw materials were weighed such that the RL-RH-B-M based alloys (including an alloy that does not include B) would have the compositions shown in Nos. 3-a through 3-k in Table 10, and were melted, to obtain alloys in a ribbon or flake form by a single roll rapid quenching method (melt spinning method). The resultant alloys were each pulverized in an argon atmosphere in a mortar to prepare an RL-RH-B-M based alloy. Table 10 shows the compositions of the resultant RL-RH-B-M based alloys.

TABLE 10

| | COMPOSITON OF RL-RH-B-M BASED ALLOY (mass %) | | | | | | | | |
|---|---|---|---|---|---|---|---|---|---|
| | RL | | RH | | B | M | | | |
| No. | Nd | Pr | Tb | Dy | B | Cu | Ga | Fe | Al |
| 3-a | 0.3 | 79.5 | 10.0 | 0.0 | 0.00 | 2.61 | 6.80 | — | 0.06 |
| 3-b | 0.4 | 78.0 | 10.0 | 0.0 | 0.30 | 2.58 | 6.69 | 1.20 | 0.00 |
| 3-c | 0.4 | 77.1 | 10.2 | 0.0 | 0.54 | 2.52 | 6.67 | 2.22 | 0.00 |
| 3-d | 0.3 | 74.9 | 10.0 | 0.0 | 0.94 | 2.49 | 6.49 | 3.80 | 0.01 |
| 3-e | 0.3 | 70.9 | 10.1 | 0.0 | 1.94 | 2.40 | 6.20 | 7.27 | 0.02 |
| 3-f | 0.3 | 66.7 | 10.1 | 0.0 | 2.86 | 2.26 | 5.88 | 10.93 | 0.03 |
| 3-g | 0.4 | 77.8 | 9.8 | 0.0 | 0.30 | 2.58 | 6.70 | 1.18 | 0.00 |
| 3-h | 0.4 | 76.6 | 9.6 | 0.0 | 0.55 | 2.57 | 6.60 | 2.38 | 0.00 |
| 3-i | 0.4 | 74.5 | 9.7 | 0.0 | 0.95 | 2.53 | 6.42 | 3.68 | 0.00 |
| 3-j | 0.4 | 71.9 | 9.1 | 0.0 | 1.89 | 2.37 | 6.19 | 7.29 | 0.02 |
| 3-k | 0.3 | 67.8 | 8.6 | 0.0 | 2.81 | 2.24 | 5.83 | 11.02 | 0.03 |

[Diffusion Step]

The sintered R-T-B based magnet works of Nos. 3-A and 3-B in Table 9 were each cut and ground into a 7.2 mm×7.2 mm×7.2 mm cube. Next, an adhesive containing sugar alcohol was applied to the entire surface of each of the sintered R-T-B based magnet works by a dipping method. A powder of each of the RL-RH-B-M based alloys was applied to the corresponding sintered R-T-B based magnet work having the adhesive applied thereto at a ratio of 3 mass % with respect to the mass of the sintered R-T-B based magnet work. Next, the diffusion step was performed, in which the RL-RH-B-M based alloy and the sintered R-T-B based magnet work were heated at 900° C. for 10 hours in a vacuum heat treatment furnace. Then, the resultant substance was cooled. After this, the resultant sintered R-T-B based magnet was heated at a temperature not lower than 470° C. and not higher than 530° C. for 1 hour in a vacuum heat treatment furnace, and then cooled.

[Evaluation of Samples]

The $B_r$ and the $H_{cJ}$ of each of the sintered R-T-B based magnet works and each of the resultant samples (post-heat treatment sintered R-T-B based magnets) were measured by a B-H tracer. Table 11 shows the results of measurement of the $B_r$ and the $H_{cJ}$ of each of the magnet works and each of the sintered R-T-B based magnets, and $\Delta B_r$ of each of the sintered R-T-B based magnets. For each of the sintered R-T-B based magnets, $\Delta B_r$ was obtained by subtracting the value of $B_r$ of the sintered R-T-B based magnet work (pre-diffusion $B_r$) from the value of Br of the sintered R-T-B based magnet (post-diffusion $B_r$). The components of the samples were measured by use of Inductively Coupled Plasma Optical Emission Spectrometry (ICP-OES). The results are shown in Table 12. Referring to Table 11, in comparative example samples Nos. 3-2, 3-8, 3-15 and 3-21, the alloy not containing B was diffused in Nos. 3-1 and 3-14 of the sintered R-T-B based magnet works. As seen from Table 11, in each of the comparative example samples, high $H_{cJ}$ is obtained but the $B_r$ is significantly decreased. In example samples Nos. 3-3 through 3-7, 3-9 through 3-13, 3-16 through 3-20 and 3-22 through 3-26, the RL-RH-B-M based alloys were diffused in Nos. 3-1 and 3-14 of the sintered R-T-B based magnet works. As seen from Table 11, in contrast to the comparative example samples, in each of the example samples, high $H_{cJ}$ is obtained in the diffusion step and the decrease in the $B_r$ is very little. As can be seen, sintered R-T-B based magnets having a good balance of the $B_r$ and the $H_{cJ}$ are obtained. A piece having a size of 1×1×1 mm was cut out from the surface region and the interior of the magnet of each of the samples, and [T]/[B] and the gradual decreases in the concentration of B and the concentration of RH were checked by use of Inductively Coupled Plasma Optical Emission Spectrometry (ICP-OES). The results are shown in Table 11. As described above, in comparative example samples Nos. 3-2, 3-8, 3-15 and 3-21, the alloy not containing B was diffused. In example samples Nos. 3-3 through 3-7, 3-9 through 3-13, 3-16 through 3-20 and 3-22 through 3-26, the RL-RH-B-M based alloy was diffused. As seen from Table 11, in contrast to the comparative example samples, in each of the example samples, [T]/[B] in the surface region of the magnet is lower than [T]/[B] in the interior of the magnet. As can be seen, the concentration of B gradually decreases.

TABLE 11

| | CONDITIONS FOR PRODUCTION | | | | | | | | | | | |
|---|---|---|---|---|---|---|---|---|---|---|---|---|
| SAMPLE No. | SINTERED R-T-B BASED MAGNET WORK No. | RL-RH-B-M BASED ALLOY No. | ATTACHED AMOUNT OF RL-RH-B-M BASED ALLOY (mass %) | DIFFUSION STEP | Br (T) | ΔBr (T) | HcJ (kA/m) | SURFACE REGION OF MAGNET [T]/[B] | CENTRAL REGION OF MAGNET [T]/[B] | GRADUAL DECREASE IN B CONCENTRATION | GRADUAL DECREASE IN RH CONCENTRATION | REMARKS |
| 3-1 | 3-A | — | — | — | 1.47 | — | — | — | — | — | — | COMPARATIVE EX |
| 3-2 | 3-A | 3-a | 3.1 | 900° C. × 10 h | 1.42 | −0.06 | 2041 | 14.71 | 14.49 | x | ○ | COMPARATIVE EX |
| 3-3 | 3-A | 3-b | 3.0 | 900° C. × 10 h | 1.44 | −0.03 | 1989 | 14.69 | 14.97 | ○ | ○ | EXAMPLE |
| 3-4 | 3-A | 3-c | 3.0 | 900° C. × 10 h | 1.45 | −0.02 | 1968 | 14.69 | 15.09 | ○ | ○ | EXAMPLE |
| 3-5 | 3-A | 3-d | 3.0 | 900° C. × 10 h | 1.45 | −0.02 | 1928 | 14.44 | 14.80 | ○ | ○ | EXAMPLE |
| 3-6 | 3-A | 3-e | 3.0 | 900° C. × 10 h | 1.46 | −0.01 | 1931 | 14.51 | 15.07 | ○ | ○ | EXAMPLE |
| 3-7 | 3-A | 3-f | 3.0 | 900° C. × 10 h | 1.46 | −0.01 | 1900 | 14.25 | 14.89 | ○ | ○ | EXAMPLE |
| 3-8 | 3-A | 3-a | 3.1 | 900° C. × 10 h | 1.42 | −0.06 | 2041 | 15.10 | 14.77 | x | ○ | COMPARATIVE EX |
| 3-9 | 3-A | 3-g | 2.9 | 900° C. × 10 h | 1.45 | −0.02 | 1985 | 14.89 | 14.96 | ○ | ○ | EXAMPLE |
| 3-10 | 3-A | 3-h | 3.0 | 900° C. × 10 h | 1.45 | −0.03 | 1968 | 14.80 | 15.26 | ○ | ○ | EXAMPLE |
| 3-11 | 3-A | 3-i | 3.0 | 900° C. × 10 h | 1.45 | −0.02 | 1932 | 14.45 | 15.30 | ○ | ○ | EXAMPLE |
| 3-12 | 3-A | 3-j | 3.1 | 900° C. × 10 h | 1.45 | −0.02 | 1892 | 14.57 | 15.33 | ○ | ○ | EXAMPLE |
| 3-13 | 3-A | 3-k | 2.9 | 900° C. × 10 h | 1.46 | −0.01 | 1752 | 14.65 | 14.81 | ○ | ○ | EXAMPLE |
| 3-14 | 3-B | — | — | — | 1.47 | — | — | — | — | — | — | COMPARATIVE EX |
| 3-15 | 3-B | 3-a | 3.1 | 900° C. × 10 h | 1.42 | −0.05 | 2034 | 14.71 | 14.49 | x | ○ | COMPARATIVE EX |
| 3-16 | 3-B | 3-b | 3.1 | 900° C. × 10 h | 1.43 | −0.03 | 2039 | 14.39 | 14.88 | ○ | ○ | EXAMPLE |
| 3-17 | 3-B | 3-c | 3.1 | 900° C. × 10 h | 1.44 | −0.03 | 2022 | 14.35 | 14.98 | ○ | ○ | EXAMPLE |
| 3-18 | 3-B | 3-d | 3.0 | 900° C. × 10 h | 1.44 | −0.03 | 2009 | 14.45 | 15.09 | ○ | ○ | EXAMPLE |
| 3-19 | 3-B | 3-e | 3.0 | 900° C. × 10 h | 1.45 | −0.02 | 1999 | 14.55 | 14.84 | ○ | ○ | EXAMPLE |
| 3-20 | 3-B | 3-f | 3.0 | 900° C. × 10 h | 1.45 | −0.02 | 1937 | 14.63 | 15.03 | ○ | ○ | EXAMPLE |
| 3-21 | 3-B | 3-a | 3.1 | 900° C. × 10 h | 1.42 | −0.05 | 2034 | 15.10 | 14.77 | x | ○ | COMPARATIVE EX |
| 3-22 | 3-B | 3-g | 3.0 | 900° C. × 10 h | 1.43 | −0.03 | 2053 | 15.00 | 15.13 | ○ | ○ | EXAMPLE |
| 3-23 | 3-B | 3-h | 2.9 | 900° C. × 10 h | 1.44 | −0.03 | 2020 | — | — | — | — | EXAMPLE |
| 3-24 | 3-B | 3-i | 3.0 | 900° C. × 10 h | 1.45 | −0.02 | 1999 | 14.55 | 15.03 | ○ | ○ | EXAMPLE |
| 3-25 | 3-B | 3-j | 3.0 | 900° C. × 10 h | 1.44 | −0.02 | 1960 | 14.63 | 14.78 | ○ | ○ | EXAMPLE |
| 3-26 | 3-B | 3-k | 3.0 | 900° C. × 10 h | 1.45 | −0.02 | 1803 | 14.81 | 15.07 | ○ | ○ | EXAMPLE |

TABLE 12

| SAMPLE | RESULTS OF COMPONENT ANALYSIS | | | | | | | | | | | | |
|---|---|---|---|---|---|---|---|---|---|---|---|---|---|
| No. | Nd | Pr | Tb | Dy | Fe | Co | Al | Mn | Si | B | Cu | Ga | Zr |
| 3-2 | 22.0 | 7.0 | 0.14 | 0.28 | 68.0 | 0.47 | 0.07 | 0.04 | 0.05 | 0.92 | 0.08 | 0.46 | 0.05 |
| 3-3 | 22.0 | 6.9 | 0.14 | 0.28 | 68.1 | 0.47 | 0.07 | 0.04 | 0.04 | 0.93 | 0.07 | 0.46 | 0.05 |

TABLE 12-continued

| SAMPLE | RESULTS OF COMPONENT ANALYSIS | | | | | | | | | | | | |
|---|---|---|---|---|---|---|---|---|---|---|---|---|---|
| No. | Nd | Pr | Tb | Dy | Fe | Co | Al | Mn | Si | B | Cu | Ga | Zr |
| 3-4 | 22.0 | 6.9 | 0.15 | 0.28 | 68.1 | 0.47 | 0.07 | 0.04 | 0.04 | 0.94 | 0.07 | 0.44 | 0.05 |
| 3-5 | 22.0 | 6.8 | 0.14 | 0.28 | 68.3 | 0.47 | 0.07 | 0.04 | 0.04 | 0.94 | 0.07 | 0.44 | 0.05 |
| 3-6 | 22.0 | 6.7 | 0.14 | 0.28 | 68.3 | 0.47 | 0.07 | 0.04 | 0.03 | 0.94 | 0.06 | 0.43 | 0.05 |
| 3-7 | 22.0 | 6.6 | 0.12 | 0.28 | 68.3 | 0.47 | 0.07 | 0.04 | 0.03 | 0.94 | 0.06 | 0.43 | 0.05 |
| 3-8 | 22.0 | 7.0 | 0.14 | 0.28 | 68.0 | 0.47 | 0.07 | 0.04 | 0.05 | 0.92 | 0.08 | 0.46 | 0.05 |
| 3-9 | 22.0 | 6.9 | 0.14 | 0.28 | 68.0 | 0.47 | 0.07 | 0.04 | 0.04 | 0.93 | 0.07 | 0.45 | 0.05 |
| 3-10 | 21.9 | 6.8 | 0.14 | 0.28 | 68.1 | 0.47 | 0.07 | 0.04 | 0.04 | 0.94 | 0.07 | 0.44 | 0.05 |
| 3-11 | 22.0 | 6.8 | 0.14 | 0.28 | 68.1 | 0.47 | 0.07 | 0.04 | 0.04 | 0.94 | 0.07 | 0.45 | 0.05 |
| 3-12 | 22.0 | 6.7 | 0.12 | 0.28 | 68.2 | 0.47 | 0.07 | 0.04 | 0.03 | 0.94 | 0.06 | 0.44 | 0.05 |
| 3-13 | 22.1 | 6.6 | 0.08 | 0.28 | 68.3 | 0.47 | 0.07 | 0.04 | 0.04 | 0.94 | 0.06 | 0.42 | 0.05 |
| 3-15 | 22.0 | 7.1 | 0.15 | 0.28 | 67.9 | 0.47 | 0.07 | 0.04 | 0.05 | 0.91 | 0.08 | 0.47 | 0.05 |
| 3-16 | 22.0 | 7.0 | 0.15 | 0.28 | 67.9 | 0.47 | 0.07 | 0.04 | 0.04 | 0.92 | 0.08 | 0.46 | 0.05 |
| 3-17 | 22.0 | 7.0 | 0.16 | 0.28 | 67.9 | 0.47 | 0.07 | 0.04 | 0.04 | 0.93 | 0.07 | 0.46 | 0.05 |
| 3-18 | 22.0 | 6.9 | 0.16 | 0.28 | 68.0 | 0.47 | 0.07 | 0.04 | 0.04 | 0.93 | 0.07 | 0.45 | 0.05 |
| 3-19 | 22.0 | 6.8 | 0.15 | 0.28 | 68.3 | 0.47 | 0.07 | 0.04 | 0.04 | 0.93 | 0.07 | 0.44 | 0.05 |
| 3-20 | 22.0 | 6.7 | 0.12 | 0.28 | 68.2 | 0.47 | 0.07 | 0.04 | 0.04 | 0.93 | 0.07 | 0.44 | 0.05 |
| 3-21 | 22.0 | 7.1 | 0.15 | 0.28 | 67.9 | 0.47 | 0.07 | 0.04 | 0.05 | 0.91 | 0.08 | 0.47 | 0.05 |
| 3-22 | 22.0 | 7.1 | 0.16 | 0.28 | 67.9 | 0.47 | 0.07 | 0.04 | 0.04 | 0.92 | 0.07 | 0.46 | 0.05 |
| 3-23 | 22.0 | 6.9 | 0.15 | 0.28 | 67.9 | 0.47 | 0.07 | 0.04 | 0.04 | 0.92 | 0.07 | 0.45 | 0.05 |
| 3-24 | 22.0 | 6.9 | 0.14 | 0.28 | 67.9 | 0.47 | 0.07 | 0.04 | 0.04 | 0.93 | 0.07 | 0.46 | 0.05 |
| 3-25 | 22.0 | 6.8 | 0.14 | 0.28 | 67.9 | 0.47 | 0.07 | 0.04 | 0.04 | 0.94 | 0.07 | 0.44 | 0.05 |
| 3-26 | 22.1 | 6.6 | 0.08 | 0.28 | 68.4 | 0.47 | 0.07 | 0.04 | 0.04 | 0.93 | 0.06 | 0.43 | 0.05 |

Experiment Example 4 [Step of Preparing a Sintered R-T-B Based Magnet Work (Magnet Work)]

The raw materials were weighed such that the sintered R-T-B based magnet work would have the composition shown in No. 4-A in Table 13, and were cast by a strip casting method. As a result, raw material alloys in a flake form each having a thickness of 0.2 to 0.4 mm were obtained. The resultant raw material alloys in the flake form were each hydrogen-pulverized and then dehydrogenated, more specifically, heated to 550° C. and then cooled in a vacuum, to obtain a coarse-pulverized powder. Next, the resultant coarse-pulverized powder was pulverized by use of an airflow crusher (jet mill) to obtain a fine-pulverized powder (alloy powder) having a particle size $D_{50}$ of 3 μm. The particle size $D_{50}$ is a central value of volume (volume-based median diameter) obtained by an airflow-dispersion laser diffraction method.

The resultant fine-pulverized powder was pressed in a magnetic field to obtain a compact. As a pressing apparatus, a so-called orthogonal magnetic field pressing apparatus (transverse magnetic field pressing apparatus) was used, by which the direction of magnetic field application was orthogonal to the pressurizing direction.

The resultant compact was sintered at a temperature not lower than 1000° C. and not higher than 1050° C. (a temperature at which a sufficiently dense texture would result through sintering was selected for the sintered R-T-B based magnet work) for 10 hours in a vacuum and then quenched to obtain a magnet work. The resultant magnet work had a density not lower than 7.5 Mg/m$^3$. Measurement results on the components of the resultant magnet work are shown in Table 13. The content of each of the components in Table 13 was measured by using Inductively Coupled Plasma Optical Emission Spectroscopy (ICP-OES). The amount of oxygen in the magnet work was measured by a gas fusion infrared absorption method, and was confirmed to be about 0.2 mass %. The amount of C (carbon) in the magnet work was measured by a combustion infrared absorption method by use of a gas analyzer, and was confirmed to be about 0.1 mass %.

TABLE 13

| | COMPOSITION OF SINTERED R-T-B BASED MAGNET WORK (mass %) | | | | | | | | | | | | |
|---|---|---|---|---|---|---|---|---|---|---|---|---|---|
| | R | | | T | | | | | B | | | | [T]/ |
| No. | Nd | Pr | Dy | Fe | Co | Al | Mn | Si | B | Cu | Ga | Zr | [B] |
| 4-A | 22.7 | 5.5 | 0.3 | 69.4 | 0.49 | 0.08 | 0.04 | 0.04 | 0.94 | 0.01 | 0.31 | 0.05 | 14.4 |

[Step of Preparing RL-RH-B-M Based Alloys]

The raw materials were weighed such that the RL-RH-B-M based alloys (including an alloy that does not include B) would have the compositions shown in Nos. 4-a through 4-h in Table 14, and were melted, to obtain alloys in a ribbon or flake form by a single roll rapid quenching method (melt spinning method). The resultant alloys were each pulverized in an argon atmosphere in a mortar to prepare an RL-RH-B-M based alloy. Table 14 shows the compositions of the resultant RL-RH-B-M based alloys.

TABLE 14

| | COMPOSITON OF RL-RH-B-M BASED ALLOY (mass %) | | | | | | | |
|---|---|---|---|---|---|---|---|---|
| | RL | | RH | | B | M | | |
| No. | Nd | Pr | Tb | Dy | B | Cu | Ga | Al |
| 4-a | 0.3 | 79.5 | 10.0 | 0.0 | 0.00 | 2.61 | 6.80 | 0.06 |
| 4-b | 0.4 | 79.2 | 10.0 | 0.0 | 0.15 | 2.64 | 6.87 | 0.00 |

TABLE 14-continued

| | COMPOSITON OF RL-RH-B-M BASED ALLOY (mass %) | | | | | | | |
|---|---|---|---|---|---|---|---|---|
| | RL | | RH | | B | M | | |
| No. | Nd | Pr | Tb | Dy | B | Cu | Ga | Al |
| 4-c | 0.4 | 80.5 | 10.2 | 0.0 | 0.23 | 2.61 | 6.98 | 0.00 |
| 4-d | 0.3 | 78.9 | 10.0 | 0.0 | 0.39 | 2.63 | 6.79 | 0.00 |
| 4-e | 0.3 | 78.5 | 10.1 | 0.0 | 0.82 | 2.60 | 6.80 | 0.00 |
| 4-f | 0.3 | 78.6 | 10.0 | 0.0 | 1.28 | 2.62 | 6.85 | 0.00 |
| 4-g | 0.3 | 77.5 | 10.2 | 0.0 | 1.76 | 2.60 | 6.58 | 0.00 |
| 4-h | 0.3 | 77.3 | 9.7 | 0.0 | 2.13 | 2.63 | 6.81 | 0.00 |

[Diffusion Step]

The sintered R-T-B based magnet work of No. 4-A in Table 13 was cut and ground into a 7.2 mm×7.2 mm×7.2 mm cube. Next, an adhesive containing sugar alcohol was applied to the entire surface of the sintered R-T-B based magnet work by a dipping method. A powder of each of the RL-RH-B-M based alloys was applied to the sintered R-T-B based magnet work having the adhesive applied thereto at a ratio of 3 mass % with respect to the mass of the sintered R-T-B based magnet work. Next, the diffusion step was performed, in which the RL-RH-B-M based alloy and the sintered R-T-B based magnet work were heated at 900° C. for 10 hours in a vacuum heat treatment furnace. Then, the resultant substance was cooled. After this, the resultant sintered R-T-B based magnet was heated at a temperature not lower than 470° C. and not higher than 530° C. for 1 hour in a vacuum heat treatment furnace, and then cooled.

[Evaluation of Samples]

The $B_r$ and the $H_{cJ}$ of the sintered R-T-B based magnet work and each of the resultant samples (post-heat treatment sintered R-T-B based magnets) were measured by a B-H tracer. Table 15 shows the results of measurement of the $B_r$ and the $H_{cJ}$ of the magnet work and each of the sintered R-T-B based magnets, and $\Delta B_r$ of each of the sintered R-T-B based magnets. For each of the sintered R-T-B based magnets, $\Delta B_r$ was obtained by subtracting the value of $B_r$ of the sintered R-T-B based magnet work (pre-diffusion Br) from the value of $B_r$ of the sintered R-T-B based magnet (post-diffusion Br). The components of the samples were measured by use of Inductively Coupled Plasma Optical Emission Spectrometry (ICP-OES). The results are shown in Table 16. Referring to Table 15, in comparative example sample No. 4-2, the alloy not containing B was diffused in No. 4-1 of the sintered R-T-B based magnet work. As seen from Table 15, in the comparative example sample, high $H_{cJ}$ is obtained but the Br is significantly decreased. In example samples Nos. 4-3 through 4-9, the RL-RH-B-M based alloys were diffused in No. 4-1 of the sintered R-T-B based magnet work. As seen from Table 15, in contrast to the comparative example sample, in each of the example samples, high $H_{cJ}$ is obtained in the diffusion step and the decrease in the $B_r$ is very little. As can be seen, sintered R-T-B based magnets having a good balance of the Br and the $H_{cJ}$ are obtained. A piece having a size of 1×1×1 mm was cut out from the surface region and the interior of the magnet of each of the samples, and [T]/[B] and the gradual decreases in the concentration of B and the concentration of RH were checked by use of Inductively Coupled Plasma Optical Emission Spectrometry (ICP-OES). The results are shown in Table 15. As seen from Table 15, in each of example samples Nos. 4-3, 4-4 and 4-6 through 4-9, in which the RL-RH-B-M based alloy was diffused, [T]/[B] in the surface region of the magnet is lower than [T]/[B] in the interior of the magnet. As can be seen, the concentration of B gradually decreases.

TABLE 15

| | CONDITIONS FOR PRODUCTION | | | | | | | | | | | |
|---|---|---|---|---|---|---|---|---|---|---|---|---|
| SAMPLE No. | SINTERED R-T-B BASED MAGNET WORK No. | RL-RH-B-M BASED ALLOY No. | ATTACHED AMOUNT OF RL-RH-B-M BASED ALLOY (mass %) | DIFFUSION STEP | Br (T) | ΔBr (T) | HcJ (kA/m) | SURFACE REGION OF MAGNET [T]/[B] | CENTRAL REGION OF MAGNET [T]/[B] | GRADUAL DECREASE IN B CONCENTRATION | GRADUAL DECREASE IN RH CONCENTRATION | REMARKS |
| 4-1 | 4-A | — | — | — | 1.48 | — | — | — | — | — | — | COMPARATIVE EX |
| 4-2 | 4-A | 4-a | 3.1 | 900° C. × 10 h | 1.42 | −0.06 | 2041 | 14.71 | 14.49 | x | ○ | COMPARATIVE EX |
| 4-3 | 4-A | 4-b | 2.9 | 900° C. × 10 h | 1.44 | −0.04 | 2006 | 14.72 | 14.86 | ○ | ○ | EXAMPLE |
| 4-4 | 4-A | 4-c | 2.9 | 900° C. × 10 h | 1.44 | −0.03 | 1996 | 14.55 | 15.42 | ○ | ○ | EXAMPLE |
| 4-5 | 4-A | 4-d | 3.0 | 900° C. × 10 h | 1.44 | −0.03 | 1992 | — | — | — | — | EXAMPLE |
| 4-6 | 4-A | 4-e | 3.1 | 900° C. × 10 h | 1.45 | −0.03 | 1988 | 14.28 | 14.73 | ○ | ○ | EXAMPLE |
| 4-7 | 4-A | 4-f | 2.9 | 900° C. × 10 h | 1.46 | −0.02 | 1924 | 14.50 | 14.70 | ○ | ○ | EXAMPLE |
| 4-8 | 4-A | 4-g | 3.0 | 900° C. × 10 h | 1.45 | −0.02 | 1919 | 14.35 | 14.43 | ○ | ○ | EXAMPLE |
| 4-9 | 4-A | 4-h | 2.9 | 900° C. × 10 h | 1.45 | −0.02 | 1748 | 14.47 | 15.12 | ○ | ○ | EXAMPLE |

TABLE 16

| SAMPLE | RESULTS OF COMPONENT ANALYSIS | | | | | | | | | | | | |
|---|---|---|---|---|---|---|---|---|---|---|---|---|---|
| No. | Nd | Pr | Tb | Dy | Fe | Co | Al | Mn | Si | B | Cu | Ga | Zr |
| 4-2 | 22.0 | 7.0 | 0.14 | 0.28 | 68.0 | 0.47 | 0.07 | 0.04 | 0.05 | 0.92 | 0.08 | 0.46 | 0.05 |
| 4-3 | 22.0 | 6.9 | 0.13 | 0.28 | 67.9 | 0.47 | 0.07 | 0.04 | 0.04 | 0.92 | 0.07 | 0.47 | 0.05 |
| 4-4 | 22.0 | 6.9 | 0.13 | 0.28 | 67.9 | 0.47 | 0.07 | 0.04 | 0.04 | 0.93 | 0.07 | 0.46 | 0.05 |
| 4-5 | 22.0 | 6.8 | 0.15 | 0.28 | 68.1 | 0.47 | 0.07 | 0.04 | 0.04 | 0.94 | 0.07 | 0.44 | 0.05 |
| 4-6 | 21.9 | 6.8 | 0.14 | 0.28 | 68.2 | 0.47 | 0.08 | 0.04 | 0.05 | 0.94 | 0.06 | 0.44 | 0.05 |
| 4-7 | 22.0 | 6.7 | 0.13 | 0.28 | 68.3 | 0.47 | 0.07 | 0.04 | 0.04 | 0.94 | 0.06 | 0.43 | 0.05 |

TABLE 16-continued

| SAMPLE | RESULTS OF COMPONENT ANALYSIS | | | | | | | | | | | | |
|---|---|---|---|---|---|---|---|---|---|---|---|---|---|
| No. | Nd | Pr | Tb | Dy | Fe | Co | Al | Mn | Si | B | Cu | Ga | Zr |
| 4-8 | 22.0 | 6.7 | 0.12 | 0.28 | 68.3 | 0.47 | 0.07 | 0.04 | 0.05 | 0.94 | 0.06 | 0.44 | 0.05 |
| 4-9 | 22.0 | 6.7 | 0.10 | 0.28 | 68.4 | 0.47 | 0.08 | 0.04 | 0.05 | 0.94 | 0.06 | 0.44 | 0.05 |

Experiment Example 5 [Step of Preparing Sintered R-T-B Based Magnet Works (Magnet Works)]

The raw materials were weighed such that the sintered R-T-B based magnet works would have the compositions shown in Nos. 5-A through 5-D in Table 17, and were cast by a strip casting method. As a result, raw material alloys in a flake form each having a thickness of 0.2 to 0.4 mm were obtained. The resultant raw material alloys in the flake form were each hydrogen-pulverized and then dehydrogenated, more specifically, heated to 550° C. and then cooled in a vacuum, to obtain a coarse-pulverized powder. Next, the resultant coarse-pulverized powder was pulverized by use of an airflow crusher (jet mill) to obtain a fine-pulverized powder (alloy powder) having a particle size $D_{50}$ of 3 μm. The particle size $D_{50}$ is a central value of volume (volume-based median diameter) obtained by an airflow-dispersion laser diffraction method.

The resultant fine-pulverized powder was pressed in a magnetic field to obtain a compact. As a pressing apparatus, a so-called orthogonal magnetic field pressing apparatus (transverse magnetic field pressing apparatus) was used, by which the direction of magnetic field application was orthogonal to the pressurizing direction.

The resultant compact was sintered at a temperature not lower than 1000° C. and not higher than 1050° C. (a temperature at which a sufficiently dense texture would result through sintering was selected for each of the sintered R-T-B based magnet works) for 10 hours in a vacuum and then quenched to obtain a magnet work. The resultant magnet works each had a density not lower than 7.5 $Mg/m^3$. Measurement results on the components of the resultant magnet works are shown in Table 17. The content of each of the components in Table 17 was measured by using Inductively Coupled Plasma Optical Emission Spectroscopy (ICP-OES). The amount of oxygen in each of all the magnet works was measured by a gas fusion infrared absorption method, and was confirmed to be about 0.2 mass %. The amount of C (carbon) in each of the magnet works was measured by a combustion infrared absorption method by use of a gas analyzer, and was confirmed to be about 0.1 mass %.

TABLE 17

| | COMPOSITION OF SINTERED R-T-B BASED MAGNET WORK (mass %) | | | | | | | | | | | | |
|---|---|---|---|---|---|---|---|---|---|---|---|---|---|
| | R | | | T | | | | | B | | | | [T]/ |
| No. | Nd | Pr | Dy | Fe | Co | Al | Mn | Si | B | Cu | Ga | Zr | [B] |
| 5-A | 22.7 | 5.5 | 0.3 | 69.4 | 0.49 | 0.08 | 0.04 | 0.04 | 0.94 | 0.01 | 0.31 | 0.05 | 14.4 |
| 5-B | 22.7 | 5.4 | 0.3 | 69.5 | 0.49 | 0.07 | 0.04 | 0.04 | 0.92 | 0.01 | 0.31 | 0.05 | 14.8 |
| 5-C | 22.9 | 5.5 | 0.3 | 69.0 | 0.48 | 0.08 | 0.04 | 0.04 | 0.94 | 0.01 | 0.31 | 0.00 | 14.4 |
| 5-D | 22.9 | 5.5 | 0.3 | 68.9 | 0.48 | 0.08 | 0.04 | 0.04 | 0.92 | 0.01 | 0.31 | 0.00 | 14.7 |

[Step of Preparing RL-RH-B-M Based Alloys]

The raw materials were weighed such that the RL-RH-B-M based alloys would have the compositions shown in Nos. 5-a through 5-e in Table 18, and were melted, to obtain alloys in a ribbon or flake form by a single roll rapid quenching method (melt spinning method). The resultant alloys were each pulverized in an argon atmosphere in a mortar to prepare an RL-RH-B-M based alloy. Table 18 shows the compositions of the resultant RL-RH-B-M based alloys.

TABLE 18

| | COMPOSITON OF RL-RH-B-M BASED ALLOY (mass %) | | | | | | | |
|---|---|---|---|---|---|---|---|---|
| | RL | | RH | | B | M | | |
| No. | Nd | Pr | Tb | Dy | B | Cu | Ga | Al |
| 5-a | 0.3 | 78.5 | 10.1 | 0.0 | 0.82 | 2.60 | 6.80 | 0.00 |
| 5-b | 0.3 | 77.5 | 11.5 | 0.0 | 0.82 | 2.58 | 6.73 | 0.00 |
| 5-c | 0.3 | 76.2 | 13.1 | 0.0 | 0.80 | 2.64 | 6.78 | 0.00 |
| 5-d | 0.3 | 74.0 | 15.0 | 0.0 | 0.84 | 2.57 | 6.71 | 0.01 |
| 5-e | 0.3 | 68.6 | 20.0 | 0.0 | 0.95 | 2.57 | 6.66 | 0.00 |

[Diffusion Step]

The sintered R-T-B based magnet works of Nos. 5-A through 5-D in Table 17 were each cut and ground into a 7.2 mm×7.2 mm×7.2 mm cube. Next, an adhesive containing sugar alcohol was applied to the entire surface of each of the sintered R-T-B based magnet works by a dipping method. A powder of each of the RL-RH-B-M based alloys was applied to the corresponding sintered R-T-B based magnet work having the adhesive applied thereto at a ratio of 3 mass % with respect to the mass of the sintered R-T-B based magnet work. Next, the diffusion step was performed, in which the RL-RH-B-M based alloy and the sintered R-T-B based magnet work were heated at 900° C. for 10 hours in a vacuum heat treatment furnace. Then, the resultant substance was cooled. After this, the resultant sintered R-T-B based magnet was heated at a temperature not lower than 470° C. and not higher than 530° C. for 1 hour in a vacuum heat treatment furnace, and then cooled.

[Evaluation of Samples]

The $B_r$ and the $H_{cJ}$ of each of the sintered R-T-B based magnet works and each of the resultant samples (post-heat treatment sintered R-T-B based magnets) were measured by a B-H tracer. Table 19 shows the results of measurement of the $B_r$ and the $H_{cJ}$ of each of the magnet works and each of the sintered R-T-B based magnets, and $\Delta B_r$ of each of the sintered R-T-B based magnets. For each of the sintered R-T-B based magnets, $\Delta B_r$ was obtained by subtracting the value of $B_r$ of the sintered R-T-B based magnet work (pre-diffusion $B_r$) from the value of $B_r$ of the sintered R-T-B based magnet (post-diffusion $B_r$). The components of the samples were measured by use of Inductively Coupled Plasma Optical Emission Spectrometry (ICP-OES). The results are shown in Table 20. Referring to Table 19, in example samples Nos. 5-2 through 5-6, 5-8 through 5-10, 5-12, 5-13, 5-15 and 5-16, the RL-RH-B-M based alloys were diffused in Nos. 5-1, 5-7, 5-11 and 5-14 of the sintered R-T-B based magnet works. As seen from Table 19, in each of the example samples, high $H_{cJ}$ is obtained in the diffusion step and the decrease in the $B_r$ is very little. As can be seen, sintered R-T-B based magnets having a good balance of the $B_r$ and the $H_{cJ}$ are obtained. A piece having a size of 1×1×1 mm was cut out from the surface region and the interior of the magnet of each of the samples, and [T]/[B] and the gradual decreases in the concentration of B and the concentration of RH were checked by use of Inductively Coupled Plasma Optical Emission Spectrometry (ICP-OES). The results are shown in Table 19. As seen from Table 19, in each of example samples Nos. 5-2 through 5-6, 5-8 through 5-10, 5-12, 5-13, 5-15 and 5-16, in which the RL-RH-B-M based alloy was diffused, [T]/[B] in the surface region of the magnet is lower, by 2.0 or more, than [T]/[B] in the interior of the magnet. As can be seen, the concentration of B gradually decreases.

TABLE 19

| | CONDITIONS FOR PRODUCTION | | | | | | | | | | | |
|---|---|---|---|---|---|---|---|---|---|---|---|---|
| SAMPLE No. | SINTERED R-T-B BASED MAGNET WORK No. | RL-RH-B-M BASED ALLOY No. | ATTACHED AMOUNT OF RL-RH-B-M BASED ALLOY (mass %) | DIFFUSION STEP | Br (T) | ΔBr (T) | HcJ (kA/m) | SURFACE REGION OF MAGNET [T]/[B] | CENTRAL REGION OF MAGNET [T]/[B] | GRADUAL DECREASE IN B CONCENTRATION | GRADUAL DECREASE IN RH CONCENTRATION | REMARKS |
| 5-1 | 5-A | — | — | — | 1.48 | — | — | — | — | — | — | COMPARATIVE EX |
| 5-2 | 5-A | 5-a | 3.1 | 900° C. × 10 h | 1.45 | −0.03 | 1988 | 14.28 | 14.73 | ○ | ○ | EXAMPLE |
| 5-3 | 5-A | 5-b | 3.0 | 900° C. × 10 h | 1.46 | −0.02 | 1985 | 14.59 | 15.06 | ○ | ○ | EXAMPLE |
| 5-4 | 5-A | 5-c | 3.0 | 900° C. × 10 h | 1.45 | −0.02 | 2004 | 14.76 | 15.61 | ○ | ○ | EXAMPLE |
| 5-5 | 5-A | 5-d | 3.1 | 900° C. × 10 h | 1.45 | −0.03 | 2031 | 14.74 | 15.26 | ○ | ○ | EXAMPLE |
| 5-6 | 5-A | 5-e | 3.0 | 900° C. × 10 h | 1.45 | −0.03 | 2038 | 14.43 | 15.01 | ○ | ○ | EXAMPLE |
| 5-7 | 5-B | — | — | — | 1.49 | — | — | — | — | — | — | COMPARATIVE EX |
| 5-8 | 5-B | 5-b | 2.9 | 900° C. × 10 h | 1.44 | −0.04 | 2037 | 14.57 | 15.77 | ○ | ○ | EXAMPLE |
| 5-9 | 5-B | 5-c | 2.9 | 900° C. × 10 h | 1.45 | −0.04 | 2052 | 14.91 | 15.64 | ○ | ○ | EXAMPLE |
| 5-10 | 5-B | 5-d | 3.0 | 900° C. × 10 h | 1.44 | −0.04 | 2067 | 14.67 | 15.32 | ○ | ○ | EXAMPLE |
| 5-11 | 5-C | — | — | — | 1.48 | — | — | — | — | — | — | COMPARATIVE EX |
| 5-12 | 5-C | 5-d | 2.9 | 900° C. × 10 h | 1.44 | −0.03 | 2050 | 14.52 | 15.14 | ○ | ○ | EXAMPLE |
| 5-13 | 5-C | 5-e | 3.0 | 900° C. × 10 h | 1.44 | −0.03 | 2078 | 14.46 | 15.11 | ○ | ○ | EXAMPLE |
| 5-14 | 5-D | — | — | — | 1.47 | — | — | — | — | — | — | COMPARATIVE EX |
| 5-15 | 5-D | 5-d | 3.1 | 900° C. × 10 h | 1.44 | −0.04 | 2105 | 14.89 | 15.50 | ○ | ○ | EXAMPLE |
| 5-16 | 5-D | 5-e | 3.1 | 900° C. × 10 h | 1.44 | −0.03 | 2112 | 14.61 | 15.26 | ○ | ○ | EXAMPLE |

TABLE 20

| SAMPLE | RESULTS OF COMPONENT ANALYSIS | | | | | | | | | | | | |
|---|---|---|---|---|---|---|---|---|---|---|---|---|---|
| No. | Nd | Pr | Tb | Dy | Fe | Co | Al | Mn | Si | B | Cu | Ga | Zr |
| 5-2 | 21.9 | 6.8 | 0.14 | 0.28 | 68.2 | 0.47 | 0.08 | 0.04 | 0.05 | 0.94 | 0.06 | 0.44 | 0.05 |
| 5-3 | 21.9 | 6.7 | 0.16 | 0.27 | 68.6 | 0.47 | 0.07 | 0.04 | 0.05 | 0.94 | 0.05 | 0.40 | 0.05 |
| 5-4 | 21.9 | 6.7 | 0.17 | 0.27 | 68.6 | 0.47 | 0.08 | 0.04 | 0.05 | 0.94 | 0.05 | 0.40 | 0.05 |
| 5-5 | 21.9 | 6.7 | 0.22 | 0.27 | 68.6 | 0.47 | 0.07 | 0.03 | 0.04 | 0.94 | 0.05 | 0.41 | 0.05 |
| 5-6 | 21.9 | 6.6 | 0.24 | 0.27 | 68.7 | 0.47 | 0.08 | 0.04 | 0.05 | 0.94 | 0.05 | 0.41 | 0.05 |
| 5-8 | 21.9 | 6.8 | 0.17 | 0.27 | 68.6 | 0.47 | 0.07 | 0.04 | 0.05 | 0.93 | 0.06 | 0.41 | 0.05 |
| 5-9 | 22.0 | 6.7 | 0.19 | 0.27 | 68.5 | 0.47 | 0.07 | 0.04 | 0.05 | 0.927 | 0.05 | 0.40 | 0.05 |
| 5-10 | 22.0 | 6.7 | 0.22 | 0.27 | 68.6 | 0.47 | 0.07 | 0.04 | 0.05 | 0.926 | 0.06 | 0.41 | 0.05 |
| 5-12 | 22.2 | 6.7 | 0.25 | 0.28 | 68.3 | 0.47 | 0.08 | 0.04 | 0.05 | 0.939 | 0.05 | 0.40 | 0.00 |
| 5-13 | 22.2 | 6.6 | 0.30 | 0.28 | 68.4 | 0.47 | 0.08 | 0.04 | 0.06 | 0.938 | 0.05 | 0.41 | 0.00 |
| 5-15 | 22.2 | 6.8 | 0.27 | 0.28 | 68.2 | 0.47 | 0.08 | 0.04 | 0.05 | 0.93 | 0.06 | 0.41 | 0.00 |
| 5-16 | 22.2 | 6.7 | 0.32 | 0.28 | 68.3 | 0.47 | 0.08 | 0.04 | 0.05 | 0.93 | 0.06 | 0.42 | 0.00 |

Experiment Example 6 [Step of Preparing a Sintered R-T-B Based Magnet Work (Magnet Work)]

The raw materials were weighed such that the sintered R-T-B based magnet work would have the composition shown in No. 6-A in Table 21, and were cast by a strip casting method. As a result, raw material alloys in a flake form each having a thickness of 0.2 to 0.4 mm were obtained. The resultant raw material alloys in the flake form were each hydrogen-pulverized and then dehydrogenated, more specifically, heated to 550° C. and then cooled in a vacuum, to obtain a coarse-pulverized powder. Next, the resultant coarse-pulverized powder was pulverized by use of an airflow crusher (jet mill) to obtain a fine-pulverized powder (alloy powder) having a particle size $D_{50}$ of 3 μm. The particle size $D_{50}$ is a central value of volume (volume-based median diameter) obtained by an airflow-dispersion laser diffraction method.

The resultant fine-pulverized powder was pressed in a magnetic field to obtain a compact. As a pressing apparatus, a so-called orthogonal magnetic field pressing apparatus (transverse magnetic field pressing apparatus) was used, by which the direction of magnetic field application was orthogonal to the pressurizing direction.

The resultant compact was sintered at a temperature not lower than 1000° C. and not higher than 1050° C. (a temperature at which a sufficiently dense texture would result through sintering was selected for the sintered R-T-B based magnet work) for 10 hours in a vacuum and then quenched to obtain a magnet work. The resultant magnet work had a density not lower than 7.5 Mg/m$^3$. Measurement results on the components of the resultant magnet work are shown in Table 21. The content of each of the components in Table 21 was measured by using Inductively Coupled Plasma Optical Emission Spectroscopy (ICP-OES). The amount of oxygen in the magnet work was measured by a gas fusion infrared absorption method, and was confirmed to be about 0.2 mass %. The amount of C (carbon) in the magnet work was measured by a combustion infrared absorption method by use of a gas analyzer, and was confirmed to be about 0.1 mass %.

TABLE 21

| COMPOSITION OF SINTERED R-T-B BASED MAGNET WORK (mass %) | | | | | | | | | | | | | |
|---|---|---|---|---|---|---|---|---|---|---|---|---|---|
| | R | | | T | | | | | B | | | | [T]/ |
| No. | Nd | Pr | Dy | Fe | Co | Al | Mn | Si | B | Cu | Ga | Zr | [B] |
| 6-A | 22.9 | 5.5 | 0.3 | 69.0 | 0.48 | 0.08 | 0.04 | 0.04 | 0.94 | 0.01 | 0.31 | 0.00 | 14.4 |

[Step of Preparing RL-RH-B-M Based Alloys]

The raw materials were weighed such that the RL-RH-B-M based alloys (including an alloy that does not include B) would have the compositions shown in Nos. 6-1 through 6-j in Table 22, and were melted, to obtain alloys in a ribbon or flake form by a single roll rapid quenching method (melt spinning method). The resultant alloys were each pulverized in an argon atmosphere in a mortar to prepare an RL-RH-B-M based alloy. Table 22 shows the compositions of the resultant RL-RH-B-M based alloys.

TABLE 22

| COMPOSITON OF RL-RH-B-M BASED ALLOY (mass %) | | | | | | | | |
|---|---|---|---|---|---|---|---|---|
| | RL | | RH | | B | M | | |
| No. | Nd | Pr | Tb | Dy | B | Cu | Ga | Al |
| 6-a | 76.6 | 0.9 | 0.1 | 9.8 | 0.88 | 9.88 | — | 0.02 |
| 6-b | 79.4 | 0.4 | 0.0 | 10.2 | — | 10.10 | — | 0.01 |
| 6-c | 1.0 | 77.7 | 10.1 | 0.1 | 0.91 | 9.98 | — | 0.00 |
| 6-d | 0.5 | 79.4 | 10.5 | 0.0 | — | 9.95 | — | 0.00 |
| 6-e | 0.4 | 88.9 | 0.1 | 0.0 | 0.88 | 3.13 | 6.71 | 0.00 |
| 6-f | 0.5 | 89.4 | 0.1 | 0.0 | — | 3.20 | 6.89 | 0.00 |
| 6-g | 0.2 | 53.5 | 9.6 | 0.0 | 0.80 | 34.90 | — | 0.00 |
| 6-h | 0.2 | 62.7 | 10.4 | 0.0 | 1.06 | 25.90 | — | 0.00 |
| 6-i | 0.3 | 77.8 | 10.1 | 0.0 | 0.90 | 3.05 | 3.89 | 1.03 |
| 6-j | 0.3 | 79.3 | 10.0 | 0.0 | — | 3.13 | 3.82 | 1.04 |

[Diffusion Step]

The sintered R-T-B based magnet work of No. 6-A in Table 21 was cut and ground into a 7.2 mm×7.2 mm×7.2 mm cube. Next, an adhesive containing sugar alcohol was applied to the entire surface of the sintered R-T-B based magnet work by a dipping method. A powder of each of the RL-RH-B-M based alloys was applied to the sintered R-T-B based magnet work having the adhesive applied thereto at a ratio of 3 mass % with respect to the mass of the sintered R-T-B based magnet work. Next, the diffusion step was performed, in which the RL-RH-B-M based alloy and the sintered R-T-B based magnet work were heated at 900° C. for 10 hours in a vacuum heat treatment furnace. Then, the resultant substance was cooled. After this, the resultant sintered R-T-B based magnet was heated at a temperature not lower than 470° C. and not higher than 530° C. for 1 hour in a vacuum heat treatment furnace, and then cooled.

[Evaluation of Samples]

The $B_r$ and the $H_{cJ}$ of the sintered R-T-B based magnet work and each of the resultant samples (post-heat treatment sintered R-T-B based magnets) were measured by a B-H tracer. Table 23 shows the results of measurement of the $B_r$ and the $H_{cJ}$ of the magnet work and each of the sintered R-T-B based magnets, and $\Delta B_r$ of each of the sintered R-T-B based magnets. For each of the sintered R-T-B based magnets, $\Delta B_r$ was obtained by subtracting the value of $B_r$ of the sintered R-T-B based magnet work (pre-diffusion Br) from the value of $B_r$ of the sintered R-T-B based magnet (post-diffusion Br). The components of the samples were measured by use of Inductively Coupled Plasma Optical Emission Spectrometry (ICP-OES). The results are shown in Table 24. Referring to Table 23, in comparative example samples Nos. 6-3, 6-5, 6-7 and 6-11, the alloy not containing B was diffused in No. 6-1 of the sintered R-T-B based magnet work. As seen from Table 23, in each of the comparative example samples, high $H_{cJ}$ is obtained but the $B_r$ is significantly decreased. In example samples Nos. 6-2, 6-4, 6-6 and 6-8 through 6-10, the RL-RH-B-M based alloys were diffused in No. 6-1 of the sintered R-T-B based magnet work. As seen from Table 23, in contrast to the comparative example samples, in each of the example samples, high $H_{cJ}$ is obtained in the diffusion step and the decrease in the $B_r$ is very little. As can be seen, sintered R-T-B based magnets having a good balance of the $B_r$ and the $H_{cJ}$ are obtained. A piece having a size of 1×1×1 mm was cut out from the surface region and the interior of the magnet of each of the samples, and [T]/[B] and the gradual decreases in the concentration of B and the concentration of RH were checked by use of Inductively Coupled Plasma Optical Emission Spectrometry (ICP-OES). The results are shown in Table 23. As described above, in comparative example samples Nos. 6-3, 6-5, 6-7 and 6-11, the alloy not containing B was diffused. In example samples Nos. 6-2, 6-4, 6-6 and 6-8 through 6-10, the RL-RH-B-M based alloy was diffused. As seen from Table 23, in contrast to the comparative example samples, in each of the example samples, [T]/[B] in the surface region of the magnet is lower than [T]/[B] in the interior of the magnet. As can be seen, the concentration of B gradually decreases.

TABLE 23

| SAMPLE No. | CONDITIONS FOR PRODUCTION: SINTERED R-T-B BASED MAGNET WORK No. | RL-RH-B-M BASED ALLOY No. | ATTACHED AMOUNT OF RL-RH-B-M BASED ALLOY (mass %) | DIFFUSION STEP | Br (T) | ΔBr (T) | HcJ (kA/m) | SURFACE REGION OF MAGNET [T]/[B] | CENTRAL REGION OF MAGNET [T]/[B] | GRADUAL DECREASE IN B CONCENTRATION | GRADUAL DECREASE IN RH CONCENTRATION | REMARKS |
|---|---|---|---|---|---|---|---|---|---|---|---|---|
| 6-1 | 6-A | — | — | — | 1.48 | — | — | — | — | — | — | COMPARATIVE EX |
| 6-2 | 6-A | 6-a | 3.0 | 900° C. × 10 h | 1.45 | −0.03 | 1586 | 14.35 | 15.40 | ○ | ○ | EXAMPLE |
| 6-3 | 6-A | 6-b | 2.9 | 900° C. × 10 h | 1.42 | −0.06 | 1641 | 15.01 | 15.02 | x | ○ | COMPARATIVE EX |
| 6-4 | 6-A | 6-c | 3.1 | 900° C. × 10 h | 1.45 | −0.03 | 1951 | 14.45 | 14.90 | ○ | ○ | EXAMPLE |
| 6-5 | 6-A | 6-d | 3.0 | 900° C. × 10 h | 1.42 | −0.06 | 2037 | 14.74 | 14.74 | x | ○ | COMPARATIVE EX |
| 6-6 | 6-A | 6-e | 2.9 | 900° C. × 10 h | 1.45 | −0.03 | 1405 | 14.49 | 14.74 | ○ | x | EXAMPLE |
| 6-7 | 6-A | 6-f | 3.0 | 900° C. × 10 h | 1.43 | −0.05 | 1534 | 15.04 | 14.50 | x | x | COMPARATIVE EX |
| 6-8 | 6-A | 6-g | 3.0 | 900° C. × 10 h | 1.46 | −0.02 | 1523 | 14.84 | 15.01 | ○ | ○ | EXAMPLE |
| 6-9 | 6-A | 6-h | 2.9 | 900° C. × 10 h | 1.46 | −0.02 | 1699 | 14.93 | 15.29 | ○ | ○ | EXAMPLE |
| 6-10 | 6-A | 6-i | 2.9 | 900° C. × 10 h | 1.44 | −0.04 | 1924 | 14.55 | 14.96 | ○ | ○ | EXAMPLE |
| 6-11 | 6-A | 6-j | 3.0 | 900° C. × 10 h | 1.42 | −0.06 | 2045 | 14.87 | 14.98 | x | ○ | COMPARATIVE EX |

TABLE 24

| SAMPLE No. | RESULTS OF COMPONENT ANALYSIS: Nd | Pr | Tb | Dy | Fe | Co | Al | Mn | Si | B | Cu | Ga |
|---|---|---|---|---|---|---|---|---|---|---|---|---|
| 6-2 | 23.7 | 5.3 | 0.04 | 0.42 | 67.4 | 0.47 | 0.09 | 0.04 | 0.06 | 0.94 | 0.24 | 0.27 |
| 6-3 | 24.0 | 5.4 | 0.04 | 0.42 | 67.0 | 0.47 | 0.09 | 0.04 | 0.05 | 0.92 | 0.26 | 0.29 |
| 6-4 | 22.2 | 6.6 | 0.16 | 0.29 | 67.7 | 0.46 | 0.09 | 0.04 | 0.05 | 0.94 | 0.20 | 0.25 |
| 6-5 | 22.3 | 7.0 | 0.19 | 0.29 | 67.1 | 0.46 | 0.09 | 0.04 | 0.05 | 0.92 | 0.26 | 0.28 |
| 6-6 | 22.2 | 7.1 | 0.05 | 0.29 | 67.2 | 0.47 | 0.09 | 0.04 | 0.05 | 0.94 | 0.09 | 0.45 |
| 6-7 | 22.2 | 7.2 | 0.04 | 0.29 | 67.2 | 0.47 | 0.09 | 0.04 | 0.05 | 0.92 | 0.09 | 0.46 |
| 6-8 | 22.3 | 5.9 | 0.11 | 0.29 | 68.0 | 0.47 | 0.09 | 0.04 | 0.05 | 0.94 | 0.61 | 0.27 |
| 6-9 | 22.3 | 6.1 | 0.12 | 0.29 | 67.9 | 0.47 | 0.09 | 0.04 | 0.05 | 0.94 | 0.46 | 0.26 |
| 6-10 | 22.3 | 6.9 | 0.17 | 0.29 | 67.3 | 0.49 | 0.12 | 0.04 | 0.08 | 0.937 | 0.09 | 0.38 |
| 6-11 | 22.2 | 7.1 | 0.20 | 0.29 | 67.1 | 0.49 | 0.12 | 0.04 | 0.08 | 0.918 | 0.09 | 0.39 |

What is claimed is:

1. A sintered R-T-B based magnet, comprising:

R (R is a rare-earth element and contains, with no exception, at least one selected from the group consisting of Nd, Pr and Ce);

T (T is at least one selected from the group consisting of Fe, Co, Al, Mn and Si, and contains Fe with no exception);

B; and at least one selected from the group consisting of Cu, Ga, Ni, Ag, Zn and Sn, wherein a molar ratio [T]/[B] of T with respect to B in a surface region of the sintered R-T-B based magnet is lower than a molar ratio [T]/[B] of T with respect to B in a central region of the sintered R-T-B based magnet.

2. The sintered R-T-B based magnet of claim 1, wherein the sintered R-T-B based magnet includes a portion in which a concentration of B gradually decreases from a surface toward an interior of the sintered R-T-B based magnet.

3. The sintered R-T-B based magnet of claim 1, wherein the molar ratio [T]/[B] of T with respect to B in the surface region of the sintered R-T-B based magnet is lower, by 0.2 or more, than the molar ratio [T]/[B] of T with respect to B in the central region of the sintered R-T-B based magnet.

4. The sintered R-T-B based magnet of claim 1, wherein the sintered R-T-B based magnet contains Tb at a content lower than 0.5 mass % (including 0 mass %).

5. The sintered R-T-B based magnet of claim 2, wherein the sintered R-T-B based magnet contains Tb at a content lower than 0.5 mass % (including 0 mass %).

6. The sintered R-T-B based magnet of claim 3, wherein the sintered R-T-B based magnet contains Tb at a content lower than 0.5 mass % (including 0 mass %).

* * * * *